US008814212B2

(12) United States Patent
Bennett

(10) Patent No.: US 8,814,212 B2
(45) Date of Patent: Aug. 26, 2014

(54) APPARATUS, SYSTEM, AND METHOD FOR CONTROLLING MOVEMENT OF A USER ON SNOW

(76) Inventor: Thomas Bennett, Salt Lake City, UT (US)

( * ) Notice: Subject to any disclaimer, the term of this patent is extended or adjusted under 35 U.S.C. 154(b) by 271 days.

(21) Appl. No.: 13/184,366

(22) Filed: Jul. 15, 2011

(65) Prior Publication Data

US 2012/0200073 A1 Aug. 9, 2012

Related U.S. Application Data

(60) Provisional application No. 61/439,215, filed on Feb. 3, 2011.

(51) Int. Cl.
*A63C 11/22* (2006.01)

(52) U.S. Cl.
USPC ..... 280/819; 280/823

(58) Field of Classification Search
CPC .. A63C 17/0013; A63C 11/00; A63C 11/001; A63C 11/24
USPC ..... 280/819, 816, 809, 824, 219; 440/101, 440/102, 103; 441/55–59, 65, 66, 74, 76, 441/77; 294/179, 54.5, 52; 135/77, 82, 86
See application file for complete search history.

(56) References Cited

U.S. PATENT DOCUMENTS

| | | | | |
|---|---|---|---|---|
| 2,893,021 | A * | 7/1959 | Lundborg | 416/63 |
| 3,506,279 | A * | 4/1970 | Lambert | 280/826 |
| 3,738,674 | A * | 6/1973 | Pauls | 280/816 |
| 3,868,122 | A * | 2/1975 | Negi | 280/816 |
| 3,948,535 | A * | 4/1976 | Negi | 280/816 |
| 4,068,610 | A | 1/1978 | Tesan | |
| 5,236,222 | A * | 8/1993 | Fletcher | 280/809 |
| 5,388,673 | A * | 2/1995 | Rohner, III | 188/84 |
| 5,876,066 | A * | 3/1999 | Petkov | 280/819 |
| 6,003,915 | A | 12/1999 | Bierman | |
| 6,029,998 | A | 2/2000 | Woodard | |
| 6,139,031 | A | 10/2000 | Wingard | |
| 6,217,072 | B1 | 4/2001 | Gregg | |
| 6,217,073 | B1 | 4/2001 | Hoffman | |
| 6,345,843 | B1 | 2/2002 | Barnes | |
| 6,592,150 | B2 * | 7/2003 | Kernan | 280/809 |
| 7,172,219 | B2 | 2/2007 | Spragg et al. | |
| 7,201,401 | B1 | 4/2007 | Friedman | |
| 7,377,551 | B2 | 5/2008 | Silverman et al. | |
| 7,658,413 | B2 | 2/2010 | Malone | |
| 2004/0007865 | A1 * | 1/2004 | Rosnell | 280/819 |
| 2007/0075524 | A1 | 4/2007 | Kelly | |

(Continued)

*Primary Examiner* — Katy M Ebner
*Assistant Examiner* — Emma K Frick
(74) *Attorney, Agent, or Firm* — Goucher Patent Law; Tyler Goucher

(57) ABSTRACT

An apparatus, system, and method are disclosed for controlling movement of a user on snow. The apparatus includes a support member comprising a shaft made from a rigid material, a snow interface, and an engagement member. The snow interface extends from a first end of the shaft and includes a gliding surface opposing a propulsion surface. The engagement member is coupled to one of the gliding surface and the propulsion surface of the snow interface. The snow interface is positionable between a gliding position and a slowing position. In the gliding position, the gliding surface is positioned in contact with a surface of the snow and the engagement member is positioned out of contact with the surface of the snow. In the slowing position the engagement member is positioned in contact with the surface of the snow.

11 Claims, 15 Drawing Sheets

(56) References Cited

U.S. PATENT DOCUMENTS

| | | | | |
|---|---|---|---|---|
| 2007/0096432 | A1 | 5/2007 | Wilson | |
| 2008/0146100 | A1 | 6/2008 | Friedrich | |
| 2009/0004935 | A1* | 1/2009 | Branovits | 440/101 |
| 2010/0045000 | A1 | 2/2010 | Wasserman | |
| 2011/0187092 | A1* | 8/2011 | Nickaes | 280/824 |
| 2012/0267872 | A1* | 10/2012 | McBride | 280/219 |

* cited by examiner

APPARATUS, SYSTEM, AND METHOD FOR CONTROLLING MOVEMENT OF A USER ON SNOW

CROSS-REFERENCES TO RELATED APPLICATIONS

This application claims the benefit of U.S. Provisional Patent Application No. 61/439,215 entitled "Apparatus, System, and Method for Controlling a Snow Traversal Device in Traversing Snow" and filed on Feb. 3, 2011 for Thomas Bennett, which is incorporated herein by reference.

FIELD

This subject matter relates to snow sports and more particularly relates to an apparatus, system and method for controlling movement of a user on snow.

BACKGROUND

Snow sports are enjoyed by millions of user's throughout the world. The term snow sports is a broad term encompassing many types of sports enjoyed on snow. For example, the term snow sports may be used to reference skiing, snowboarding, monoboarding, snowshoeing, sledding, etc.

Skiing is a recreational activity using skis as equipment for traveling over snow. A skier wears a boot that is coupleable with a binding attached to the ski. Each of the user's feet are attached to a separate ski. When traveling over snow, the skier may lose his or her balance. Because the skier's feet are independently coupled to separate skis, the skier can reposition their foot to regain their balance. Skier's typically also use ski poles to assist in maintaining their balance and as a pivot point about which to make a turn.

Ski poles are designed to be positioned at a single point and are typically relatively sharp to engage snow or ice. Once a tip of the ski pole is positioned in ice or snow, the user must lift the ski pole from the snow to get ready for the next pole plant. Therefore, as a user descends a slope, the user's ski poles are intermittently engaged with the snow.

The relatively sharp nature of a tip of a ski pole makes them unsatisfactory as a gliding device used in gliding over snow, particularly powder snow. Accordingly, as a user descends a slope, the user does not continuously maintain contact between the snow and the ski pole. When the user carves a turn, the only thing typically keeping the user from falling over is the user's momentum. If the user begins to fall during a turn the user may plant a ski pole to stop the fall provided they have quick enough reflexes.

With snowboarding and monoboarding, the user's feet are coupled to a single board. Thus, when the user loses his or her balance, the user cannot reposition their feet to regain their balance. The difference between monoboarding and snowboarding is the direction with which the user's body is positioned with respect to the board. In monoboarding, the user stands with his or her feet approximately parallel to a longitudinal axis of the monoboard. In snowboarding, the user stands with his or her feet approximately transverse to a longitudinal axis of the snowboard.

With monoboarding, because the user stands with his or her feet approximately parallel to a longitudinal axis of the monoboard, the user's arms are typically positioned on either side of the monoboard. This allows a monoboarder to use a conventional pair of ski poles in a manner substantially similar to the way a skier uses a pair of ski poles. However, as discussed above, ski poles have several shortcomings when used in descending a slope.

With snowboarding, much, if not all, of the control of the board is done through the user's lower body. The user's upper body is typically not used in snowboarding. Because the user's feet are coupled to a single snowboard, if the user loses his or her balance, the user has no way of regaining their balance by repositioning their feet.

A snowboarder user stands transeverse with respect to the longitudinal axis of the snowboard. Therefore, the user's arms are typically positioned over the snowboard. This makes using a conventional ski pole awkward and difficult with a snowboard.

In descending a slope, a snowboarder points the longitudinal axis of the snowboard down the slope. The snowboarder typically controls their speed by rotating the longitudinal axis in one direction or the other and engaging an uphill edge of the snowboard with the snow.

On gradual slopes, or areas which are flat or uphill, a snowboarder may lose their momentum and stop. Because the snowboarder's feet are coupled to a single snowboard, the user cannot walk or use their legs to traverse the snow. Additionally because conventional ski poles are difficult or awkward to use with a snowboard, the snowboarder typically does not have a way to engage their upper body to propel themselves across the snow. Often, the only way to get across a flat or uphill slope is to remove the snowboard and walk.

SUMMARY

From the foregoing discussion, it should be apparent that a need exists for an apparatus, system, and method that engages a user's upper body in traversing snow. Beneficially, such an apparatus, system, and method would assist a user in propelling themselves over gradual, flat or uphill slopes, traversing tricky sections. Additionally, such an apparatus, system, and method would enhance carving characteristics, balance, and would assist in stopping a user.

The present subject matter has been developed in response to the present state of the art, and in particular, in response to the problems and needs in the art that have not yet been fully solved by currently available snow traversal devices. Accordingly, the present subject matter has been developed to provide an apparatus, system, and method for controlling movement of a user on snow that overcome many or all of the above-discussed shortcomings in the art.

The apparatus to control movement of a user on snow, in one embodiment, includes a support member, a snow interface, and an engagement member. The snow interface extends from a first end of the shaft and includes a gliding surface opposing a propulsion surface. The engagement member is coupled to one of the gliding surface and the propulsion surface of the snow interface. The snow interface is positionable between a gliding position and a slowing position. In the gliding position, the gliding surface is positioned in contact with a surface of the snow and the engagement member is positioned out of contact with the surface of the snow. In the slowing position the engagement member is positioned in contact with the surface of the snow.

In certain embodiments, the gliding surface comprises a gliding section and an engagement section. In such an embodiment, the engagement member may be an aperture disposed through the engagement section of the snow interface. In one embodiment the aperture includes a leading edge and a trailing edge. In the slowing position the trailing edge is engageable with the surface of the snow. The trailing edge, in one embodiment, is sloped such that an interface between the trailing edge of the aperture and the engagement section of the snow interface form a substantially sharp engagement edge.

In another embodiment, the engagement member is an engagement flange coupled to and extending away from the propulsion surface at an angle substantially perpendicular to the propulsion surface of the snow interface. In such an embodiment, the engagement flange is engageable with the surface of the snow to slow or stop the user.

The engagement member, in another embodiment, includes at least one cleat positioned on and extending away from the engagement section of the gliding surface of the snow interface. In certain embodiments, the engagement member includes both an aperture disposed through the engagement section and at least one cleat positioned on and extending away from the engagement section of the gliding surface of the snow interface.

The apparatus, in certain embodiments, further includes a propulsion rim. The propulsion rim extends along an interface between the gliding surface and the propulsion surface. The propulsion rim is engageable with the surface of the snow to limit movement of the snow interface with respect to the surface of the snow. In one embodiment, at least one propulsion cleat extends perpendicularly from the propulsion rim. The propulsion cleat may be used to engage the surface of the snow.

In a further embodiment, the gliding surface is rounded about a first axis such that the gliding surface is substantially convex in a first dimension. The first axis is substantially perpendicular to a longitudinal axis of the support member. In another embodiment, the gliding surface is rounded about a second axis such that the gliding surface is substantially convex in a second dimension. In such an embodiment, the second axis is substantially perpendicular to the first axis. In yet another embodiment, the gliding surface may only be rounded about the second axis.

The gliding surface of the apparatus, in certain embodiments, includes at least one gliding member. In such embodiments, the at least one gliding member is engageable with the surface of the snow to facilitate tracking of the gliding section of the snow interface along the surface of the snow.

The apparatus further includes, in one embodiment, a replacement snow interface. In such an embodiment, the snow interface is detachable such that the replacement snow interface is easily interchangeable with the snow interface. Thus, a snow interface having certain surface characteristics such as the size and shape of the engagement member and the size and shape of the gliding member may be interchangeable with a replacement snow interface. Such interchangeability may be useful for differing snow conditions or for use in different environments (i.e., resort riding, backcountry riding, etc.) In one embodiment, the length of the support member is adjustable to accommodate user heights, different snow conditions, different environments, or different riding styles (i.e., carving, powder, park riding, etc.)

The apparatus, in certain embodiments, also includes a second snow interface extending from and coupled to a second end of the support member. The second end of the support member is the end opposite the first end of the support member. Thus, in one embodiment, the apparatus includes a snow interface positioned on either end of the support member.

The apparatus to control movement of a user on snow, in another embodiment, includes a support member, a snow interface, and an engagement flange. In certain embodiments, the support member includes a shaft made from a substantially rigid material. The snow interface is coupled to and extends from a first end of the shaft. The snow interface includes a gliding surface opposing a propulsion surface. The engagement flange is coupled to and extends away from the propulsion surface of the snow interface in a direction substantially opposite a direction of the gliding surface of the snow interface.

In one embodiment, the engagement flange extends from the propulsion surface at an angle between about ninety and one hundred and thirty five degrees with respect to an average plane of the propulsion surface. In another embodiment, the engagement flange extends substantially perpendicularly from the propulsion surface.

In certain embodiments, the apparatus includes at least one propulsion cleat coupled to and extending from the snow interface. In such an embodiment, the snow interface includes a coupled end disposed opposite a free end. The coupled end of the snow interface is coupled to the first end of the shaft of the support member. The at least one propulsion cleat extends from the free end of the snow interface. The at least one propulsion cleat is engageable with the snow such that the user can move themselves forward, backward, or side to side by pushing or pulling on the support member.

In yet another embodiment, the apparatus for controlling movement of a user on snow includes a support member, a snow interface, an engagement member, and at least one propulsion cleat. The support member, in certain embodiments, is a shaft made from a substantially rigid material. The snow interface is coupled to and extends from a first end of the shaft. The snow interface includes a gliding surface opposing a propulsion surface. The snow interface also includes a coupled end disposed opposite a free end with the coupled end coupled to the first end of the shaft of the support member.

The engagement flange is coupled to the free end of the snow interface and extends away from the propulsion surface of the snow interface in a direction substantially opposite the direction of the gliding surface. The at least one propulsion cleat is coupled to the free end of the snow interface and extends along substantially a same plane as an average plane of the snow interface.

In certain embodiments, the snow interface is positionable between a slowing position, a gliding position and a propulsion position. In the slowing position the engagement flange is engageable with a surface of the snow. In the gliding position the gliding surface is positioned in contact with the surface of the snow. In the propulsion position the at least one propulsion cleat is engageable with the surface of the snow.

In one embodiment, in the gliding position, the propulsion surface of the snow interface and the at least one propulsion cleat is positioned out contact with the surface of the snow. In another embodiment, in the slowing position, the gliding surface of the snow interface and the at least one propulsion cleat are positioned out of contact with the surface of the snow. In yet another embodiment, in the propulsion position, the gliding surface and the propulsion surface of the snow interface are positioned out of contact with the surface of the snow.

Reference throughout this specification to features, advantages, or similar language does not imply that all of the features and advantages that may be realized with the present subject matter should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

Furthermore, the described features, advantages, and characteristics of the subject matter may be combined in any suitable manner in one or more embodiments. One skilled in the relevant art will recognize that the subject matter may be practiced without one or more of the specific features or advantages of a particular embodiment. In other instances, additional features and advantages may be recognized in certain embodiments that may not be present in all embodiments.

These features and advantages of the present subject matter will become more fully apparent from the following description and appended claims, or may be learned by the practice of the subject matter as set forth hereinafter.

BRIEF DESCRIPTION OF THE DRAWINGS

In order that the advantages of the subject matter may be readily understood, a more particular description of the subject matter will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the subject matter. Thus, appearances of the phrases "in one embodiment," "in an embodiment," and similar language throughout this specification may, but do not necessarily, all refer to the same embodiment.

Furthermore, the described features, structures, or characteristics of the subject matter may be combined in any suitable manner in one or more embodiments. In the following description, numerous specific details are provided for a thorough understanding of embodiments of the subject matter. One skilled in the relevant art will recognize, however, that the disclosed subject matter may be practiced without one or more of the specific details, or with other methods, components, materials, and so forth. In other instances, well-known structures, materials, or operations are not shown or described in detail to avoid obscuring aspects of the disclosed subject matter.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
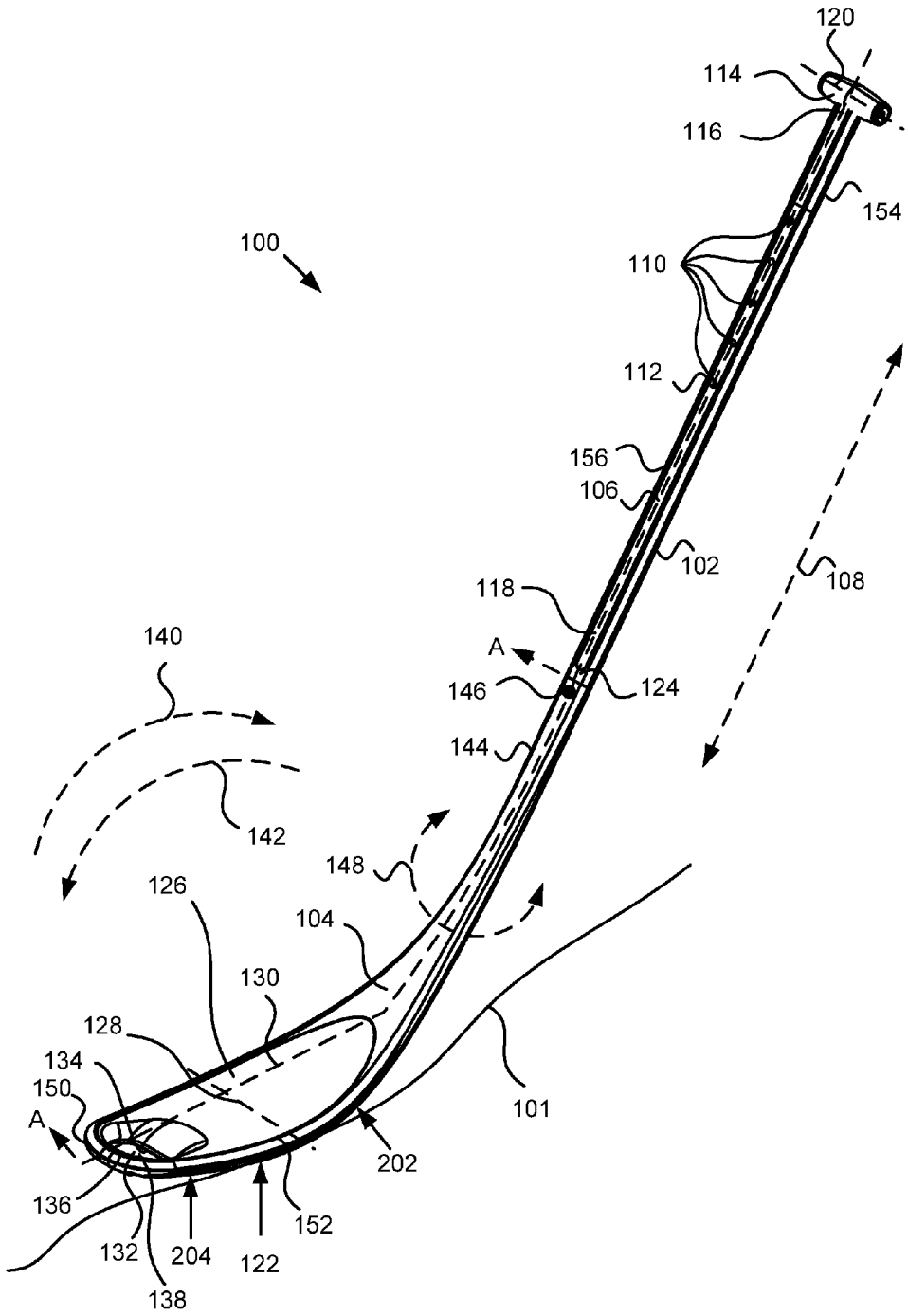
FIG. 1 depicts a perspective view of one embodiment of an apparatus for controlling movement of a user on snow.

FIG. 1 depicts a perspective view of one embodiment of an apparatus 100 for controlling movement of a user on snow 101. The snow traversal device (not shown) may be a snowboard, a ski, a pair of skis, a monoboard, a sled, or any other device configured to traverse snow. In certain embodiments, the apparatus includes a support member 102 and a snow interface 104.

The support member 102, in one embodiment, is a shaft 106 elongated in a lengthwise direction 108. The shaft 106 is made from a substantially rigid material for supporting a user. For example, in certain embodiments, the shaft 106 may be made of aluminum, fiberglass, carbon fiber, plastic, or any other material having a structural resiliency sufficient to support a user. In certain embodiments, the material comprising the shaft 106 may be selected to accommodate a desired amount of flexibility of the shaft 106. Selecting an appropriate material to achieve a desired amount flexibility of the shaft 106 is within the skill of one of skill in the art.

In one embodiment, the shaft 102 may be bent or otherwise articulated. For example, in certain embodiments, it may be desirable to have a center portion 156 of the shaft 102 positioned closer to or further from the user when the apparatus 100 is in use for better ergonomic or handling reasons. Thus, in one embodiment, rather than being elongated in the lengthwise direction 108, the shaft 102 may be bent for ergonomics or handling characteristics.

In certain embodiments, a length of the support member 106 is adjustable in the lengthwise direction 108. For example, in one embodiment, the support member 106 may include an inner shaft (not shown) received within the outer shaft 106. The inner shaft, in one embodiment, is coupled to a manipulation member 154. A series of holes 110 are positioned through the outer shaft 106 of the support member 102. A push pin 112 is coupled to the inner shaft and extends through one of the holes 110 to engage the outer shaft 106 and lock the outer shaft 106 in a predefined position. Thus, in one embodiment, the length of the support member 106 may be adjusted by extending the position of the manipulation member 154 to accommodate a taller or shorter user.

In certain embodiments, the position of the manipulation member 154 may be extended or withdrawn to accommodate different activities performed by the user. For example, in one embodiment, the user may wish to extend the position of the manipulation member 154 when the user is using the apparatus 100 as a propulsion device as further described below. By extending the position of the manipulation member 154, the user has a longer lever with which to engage the snow 101 and propel the user. In other embodiment, the user may wish to decrease the overall length of the apparatus 100 when using the apparatus as a support means when descending a snow covered surface. One of skill in the art will recognize that the overall length of the apparatus 100 may be adjusted when performing other activities.

In certain embodiments, a handle 114 is coupled to a manipulation end 116 of the manipulation member 154. The handle 114, in certain embodiments, includes finger articulations (not shown) to comfortable fit within a user's hand. In other embodiments, the handle 114 is a shortened shaft having a longitudinal axis 120 substantially perpendicular to a longitudinal axis 118 of the support member 102. In one embodiment, a user may grasp the support member 102 at or near the manipulation end 116 of the manipulation member 154. In such an embodiment, the handle 114 may be omitted.

The snow interface 104 extends from and is coupled to a first end 124 of the support member 102. The first end 124 of the support member 102 is positioned opposite the manipulation member 154. The snow interface 104 includes a gliding surface 122 positioned opposite a propulsion surface 126. As further discussed below with reference to FIG. 2, in certain embodiments, the gliding surface 122 includes a gliding section 202 and an engagement section 204. In one embodiment, the gliding section 202 and the engagement section 204 are oriented to form an obtuse angle about a first axis 128 that is substantially perpendicular to the longitudinal axis 118 of the support member 102.

While the embodiment discussed with reference to FIG. 1 includes a snow interface 104 having a gliding surface 122 and a propulsion surface 126 that are opposite surfaces of the snow interface, one of skill in the art will recognize that in other embodiments, the gliding surface 122 and the propulsion surface 126 may be separate discrete elements uncoupled to one another. Further, while the gliding surface 122 is discussed as being a single continuous surface having a gliding section 202 and an engagement section 204, one of skill in the art will recognize that the gliding section 202 and the engagement section 204, in other embodiments, may be separate discrete surfaces or elements uncoupled to one another.

In certain embodiments, the gliding surface 122 of the snow interface 104 is convex. In such an embodiment, the gliding surface 122 is rounded about the first axis 128 which is substantially perpendicular to the longitudinal axis 118 of the support member 102. Thus, in one embodiment, each of the gliding section 202 and the engagement section 204 have a convex curvature. A plane 404 (FIG. 4) that most closely approximates the curvature of the gliding section 202 and a plane 402 (FIG. 4) that most closely approximates the curvature of the engagement section 204 are aligned at an obtuse angle 406 (FIG. 4) with respect to one another.

In certain embodiments, the gliding surface 122 is rounded about a second axis 130 substantially perpendicular to the first axis 128. In one embodiment, the gliding surface 122 is only rounded about one of the first axis 128 and the second axis 130 such that the gliding surface 122 is convex in one direction. In other embodiments, the gliding surface 122 is rounded about both the first axis 128 and the second axis 130 such that the gliding surface 122 resembles a bottom surface of a spoon. In such an embodiment, the gliding surface 122 of the snow interface 104 can be positioned in any number of orientations with respect to the snow 101 covering the snow covered surface without the risk of catching an edge of the snow interface 104 on an imperfection in the snow 101 or other obstacle.

In another embodiment, the gliding section 202 and the engagement section 204 each include a substantially planar panel positioned at an obtuse angle 406 (FIG. 4) with respect to one another. In yet another embodiment, one of the gliding section 202 and the engagement section 204 of the gliding surface is substantially planar while the other of the gliding section 202 and the engagement section 204 is convex.

In certain embodiments, the gliding surface 122 is positionable between a gliding position and a slowing position. In the gliding position, the gliding section 202 of the gliding surface 122 is positioned substantially parallel to the snow 101 covering the snow covered surface. In embodiments wherein the gliding section 202 is convex, in the gliding position, a plane 404 (FIG. 4) that most closely approximates the curvature of the gliding section 202 is positioned substantially parallel to the snow 101 covering the snow covered surface. In this position, the surface area of the gliding surface 122 facilitates supporting the snow interface 104 at or near the surface of the snow 101 covering the snow covered surface. Because the support member 102 is couple to the snow interface 104, the support from the snow interface 104 may be transferred to the user through the shaft 106 of the support member 102.

In one embodiment, the engagement section 204 of the gliding surface 122 includes an engagement member 132. The engagement member 132 is engageable with the snow 101 covering the snow covered surface when the gliding surface 122 is positioned in the slowing position.

In the embodiment illustrated in FIG. 1, the engagement member 132 is an aperture 138 disposed through the engagement section 204 of the gliding surface 122. In this depiction, the aperture 138 extends from the engagement section 204 of the gliding surface 122 and through the propulsion surface 126. In other embodiments, the aperture 138 may only extend through the gliding surface 122 and not through the propulsion surface 126. The aperture 132 includes a leading surface 134 and a trailing surface 136. When the engagement section 204 of the snow interface 104 is positioned in the slowing position, the trailing surface 136 engages the snow 101 covering the snow covered surface to increase a frictional resistance between the snow interface 104 and the snow 101 covering the snow covered surface. The increased frictional resistance between the snow interface 104 and the snow 101 covering the snow covered surface can be used to slow or stop the user.

To adjust the position of the gliding surface 122 from the gliding position to the slowing position, the snow interface 104 is pivoted in the direction indicated by arrow 140. By pivoting the gliding surface 122 from the gliding position to the slowing position, the engagement section 204 is positioned substantially parallel to the snow 101 covering the snow covered surface and the engagement member 132 can be engaged with the snow 101 covering the snow covered surface. The frictional resistance between the snow interface 104 and the snow 101 covering the snow covered surface can be adjusted by increasing or decreasing a downward pressure on the snow 101. Conversely, to adjust the position of the gliding surface 122 from the slowing position to the gliding position, the snow interface 104 is pivoted in the direction indicated by arrow 142. As discussed above, in the gliding position, the gliding surface is positioned substantially parallel to snow 101 covering the snow covered surface.

In certain embodiments, surface characteristics of the gliding surface 122 of the snow interface 104 may be optimized for varying snow conditions. Optimizing the surface characteristics (i.e., the surface area of the gliding surface 122, increasing or decreasing the size of the aperture 138 or engagement member 132, including gliding members on the gliding section 202 of the gliding surface, etc.) of the gliding surface 122 are within the skill of one of skill in the art. In one embodiment, a second snow interface (not shown) may be provided having a gliding surface with surface characteristic different from the surface characteristics of the snow interface 104. The second snow interface may be configured to be interchangeable with the snow interface 104 to account for varying snow 101 conditions.

In one embodiment, a flange (not shown) coupled to the support member 102 is received within a receiving space 412 (FIG. 4) within a neck 144 of the snow interface 104. A set screw 146 extends through the neck 144 of the snow interface 104 to couple the snow interface 104 to the support member 102. In other embodiments, the set screw 146 may be replaced with a push pin (not shown) that is received within a hole (not shown) in the neck 144 of the snow interface 104 in a manner substantially similar to the way the push pin 112 is received within holes 110 described above. In this fashion, the second snow interface and the snow interface 104 can be quickly and easily interchanged. One of skill in the art will recognize other quick release mechanisms may be used to couple and uncouple the second snow interface and the snow interface 104 from the support member 102.

In certain embodiments, a hinging member (not shown) is coupled to the neck 144 of the snow interface 104 and to the end 124 of the support member 102. The hinging member, in one embodiment, allows the snow interface 104 to be folded back into a storage position with the snow interface positioned substantially parallel to the support member 102. By positioning the snow interface 104 substantially parallel to the support member 102, the apparatus 100 is more compact than when the snow interface 104 is fully extended as shown in FIG. 1, allowing the apparatus 100 to be easily stored in a backpack or other transporting device.

In one embodiment, the hinging member (not show) includes a locking member. The locking member is configured to lock the snow interface 104 in the extended position as shown in FIG. 1. In the extended position, at least a portion of the neck 144 of the snow interface 104 and the support member 102 share a common axis. Thus, in certain embodiments, in the extended position, at least a portion of the neck 144 of the snow interface 104 is positioned along an axis that extends from the longitudinal axis 118 of the support member 102. In certain embodiments, the locking member may also be configured to lock the snow interface 104 in the storage position.

Similarly, in certain embodiments a second hinging member (not shown) may be positioned between the manipulation member 154 and the support member 102. In such an embodiment, the second hinging member may be configured to position the manipulation member 154 between an extended position and a storage position. In the extended position, as shown in FIG. 1, the manipulation member 154 is positioned along an axis that extends from the longitudinal axis 118 of the support member 102. In the storage position, the manipulation member 154 is positioned substantially parallel to the support member 102.

In embodiments which include a handle 114, the handle 114 may be used by the user to assist in pivoting the apparatus 100 about the longitudinal axis 118 of the support member 102 in the direction of arrows 148 to position the snow interface 104. By pivoting the apparatus 100 about the longitudinal axis 118 of the support member 102, the user can reposition the apparatus 100 between the gliding or slowing position and a propulsion position. The gliding and slowing position are discussed above.

When the user is stopped, such as where the grade of the snow covered surface is flat or inclined, the user may use the apparatus 100 as a propulsion device. To do so, the user rotates the apparatus 100 about the longitudinal axis 118 of the support member to position the propulsion surface 126 in a propulsion orientation.

In certain embodiments, a propulsion rim 150 extends between the gliding surface 122 and the propulsion surface 126. The propulsion rim 150, in one embodiment, is disposed around the periphery 152 of the snow interface 104. In certain embodiments, the propulsion rim 150 is rounded. In other embodiments, the propulsion rim 150 is substantially planar in at least one dimension. For example, in one embodiment, the propulsion rim 150 is planar and positioned substantially perpendicular to the propulsion surface 126 and substantially perpendicular to the gliding surface 122. In yet another embodiment, the propulsion rim 150 may include two substantially planar portions that meet to form an angular point disposed around the periphery of the snow interface 104.

In the propulsion position, the propulsion rim 150 is positioned substantially parallel to the snow 101 covering the snow covered surface and is engageable with the snow 101 covering to snow covered surface to limit movement of the snow interface 104 with respect to the snow 101 covering the snow covered surface. With movement of the snow interface 104 limited with respect to the snow 101 covering the snow covered surface, a user pulls on the apparatus 100 to provide a motive force to move the user along the snow 101 covering the snow covered surface.

One of skill in the art will recognize that in certain embodiments, in the propulsion position, the snow interface 104 may be positioned in front of the user. In such a position, the propulsion rim 150 is engaged with the snow 101 to limit movement of the snow interface 104. Once the propulsion rim 150 is engaged with the snow 101 covering the snow covered surface, the user pulls on the support member 102 to move the user in a forward direction. Of course, one of skill in the art will recognize that in other embodiments, the propulsion rim 150 may be engaged with snow 101 covering the snow covered surface at a position substantially behind the user. In this position, the user may use the apparatus 100 to move the user in a substantially rearward direction. Of course, in other embodiments, the propulsion rim 150 may be positioned at a side of the user to engage the snow 101 covering the snow covered surface and allow the user to move in a sideways direction.

In certain embodiments, the propulsion surface 126 may be substantially concave. Thus, in one embodiment, the propulsion surface 126 is rounded about the first axis 128 and the second axis 130. A concave propulsion surface 126, in one embodiment, acts as a scoop to engage lighter snow 101 such as powder snow. In other embodiments, the propulsion surface 126 may be substantially planar. In yet another embodiment, the propulsion surface 126 may be convex.

In certain embodiments, the propulsion rim 150 and/or the propulsion surface 126 may be used as an engagement member to slow or stop the user. In such an embodiment, the user rotates the apparatus 100 about the longitudinal axis 118 of the support member 102 to position the propulsion surface 126 and the propulsion rim in a slowing orientation. With the propulsion rim 150 and the propulsion surface 126 positioned in the slowing position, the user can engage the snow 101 with the propulsion rim 150 and/or the propulsion surface 126 to slow the user's rate of descent.

In embodiments where the propulsion rim 150 and/or the propulsion surface 126 are used as the engagement member, the aperture 138 may be unnecessary and may be omitted. In other embodiments, where the propulsion rim 150 and/or the propulsion surface 126 are used as the engagement member, the aperture 150 may facilitate removal of snow through the propulsion surface 126. For example, as the user is descending a snow covered surface, the user may position the apparatus in the slowing position with the propulsion rim 150 engaging the surface of the snow 101. As the user drags the propulsion rim 150 along the surface of the snow 101, snow accumulates on the propulsion surface 126. The accumulated snow may cause the propulsion surface 126 to ride up and over the accumulated snow. When the propulsion surface rides up and over the accumulated snow, the slowing or stopping ability of the apparatus 100 is hindered. By including an aperture 138 through the propulsion surface, the accumulated snow has an exit path and the propulsion surface 126 may more effectively act as an engagement member to engage the snow and slow or stop the user.

Figure 2:
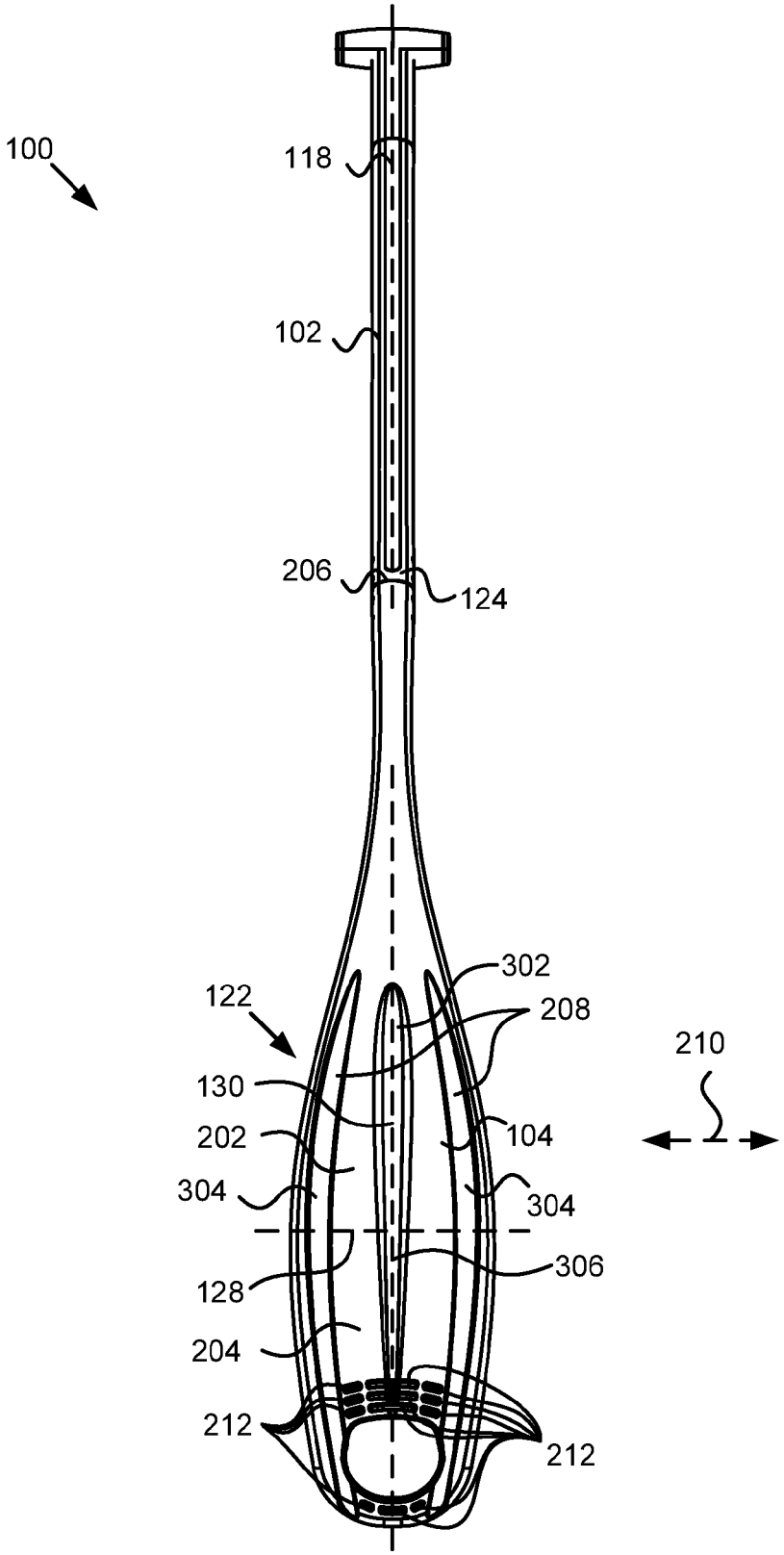
FIG. 2 depicts a bottom view of one embodiment of an apparatus for controlling movement of a user on snow.

FIG. 2 depicts a bottom view of one embodiment of an apparatus 100 for controlling movement of a user on snow 101. In the embodiment illustrated in FIG. 2, the gliding surface 122 is clearly illustrated. As discussed above, in one embodiment, the gliding surface 122 is divided into a gliding section 202 and an engagement section 204. In certain embodiment, the gliding section 202 and the engagement section 204 are separated at the first axis 128. In such an embodiment, the gliding surface 122 is rounded about axis 128 which is substantially perpendicular to the longitudinal axis 118 of the support member 102. Thus, in one embodiment, each of the gliding section 202 and the engagement section 204 have a convex curvature. A plane 404 (FIG. 4) that most closely approximates the curvature of the gliding section 202 and a plane 402 (FIG. 4) that most closely approximates the curvature of the engagement section 204 are aligned at an obtuse angle 406 (FIG. 4) with respect to one another.

In the embodiment illustrated in FIG. 2, the first axis 128 is positioned at about the center of the snow interface 104 such that the gliding section 202 and the engagement section 204 are approximately the same size. In other embodiments, the first axis 128 may be position closer to or further away from the coupling 206 between the end 124 of the support member 102 and the snow interface 104. Thus, in other embodiments, either the gliding section 202 or the engagement section 204 may be larger or smaller than is depicted in FIG. 2.

In one embodiment, the gliding surface 122 includes at least one gliding member 208. In certain embodiments, the gliding members 208 are engageable with the snow 101 covering the snow covered surface to facilitate tracking of the gliding surface 122 along the snow 101. In one embodiment, the gliding members 208 are grooves 304 disposed within the gliding surface 122. In other embodiments, the gliding members 208 include rails (not shown) or other raised ridges, such as the ridge 306 of the central gliding member 302, extending along the length of the gliding surface 122. Of course, one of skill in the art will recognize that in certain embodiments, one or more of the gliding members 208, 302 may be raised while the other gliding members 208, 302 are recessed within the gliding surface 122. In one embodiment, the gliding member(s) 208, 302 extend along the entire surface of the gliding surface 122. In other embodiment, the gliding member(s) 208, 302 only extend along the gliding section 202 of the gliding surface 122.

In one embodiment, the gliding members 208, 302 engage snow 101 to limit lateral movement of the gliding surface 122 in the direction of arrows 210 with respect to the snow 101. By limiting lateral movement of the gliding surface 122 with respect to the snow 101, the gliding surface 122 tracks along the snow 101 in a straighter line. In certain embodiments, the convex nature of the gliding surface 122 about the second axis 130 also facilitates tracking of the gliding surface 122 in a straight line along the snow 101.

The engagement section 204 of the gliding surface 104, in one embodiment, includes at least one cleat 212. The cleats 212 are engageable with the snow 101 covering the snow covered surface when the engagement section 204 is positioned in the slowing position to slow or stop movement of the gliding surface 104 with respect to the snow 101. Thus, in certain embodiments, the cleats 212 act as an engagement member 132 in a manner substantially similar to the way the aperture 138 of the engagement member 132 engages the snow 101 to slow or stop movement of the gliding surface 104 with respect to the snow 101. In one embodiment, the engagement section 204 includes both an aperture 138 and cleats 212. In other embodiments, the engagement section 204 only includes either the aperture 138 or the cleats 212 as the engagement member 132.

Figure 3:
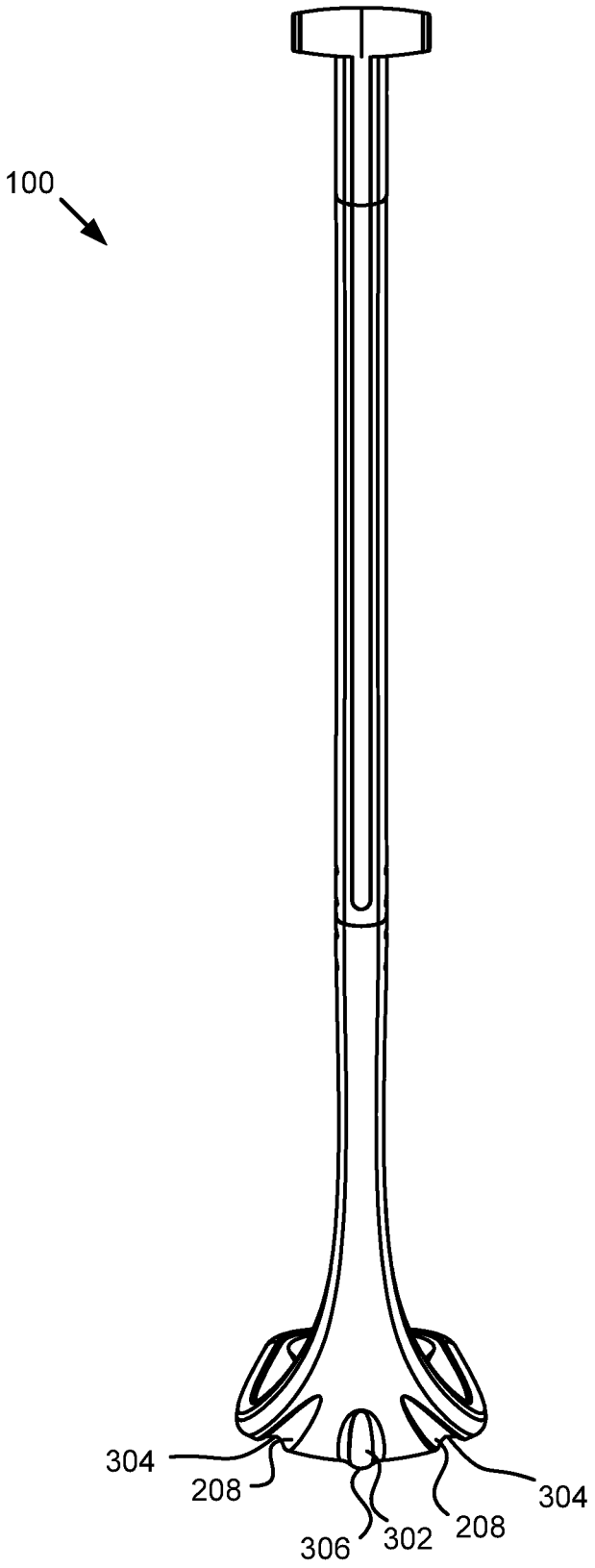
FIG. 3 depicts a rear view of one embodiment of an apparatus for controlling movement of a user on snow.

FIG. 3 depicts a rear view of one embodiment of an apparatus 100 for controlling movement of a user on snow 101. As discussed above, in certain embodiments, the gliding members 208 are grooves disposed lengthwise along the gliding surface 122. In one embodiment, the raised central gliding member 302 also runs lengthwise along the center of the gliding surface 122. One of skill in the art will recognize that in certain embodiments, the raised central gliding member 302 and the grooves of the gliding members 208 may be integral with the gliding surface 122. That is, in one embodiment, the gliding surface 122 may be molded to include the grooves 304 of the gliding members 208 and the ridge 306 of the central gliding member 302.

Figure 4:
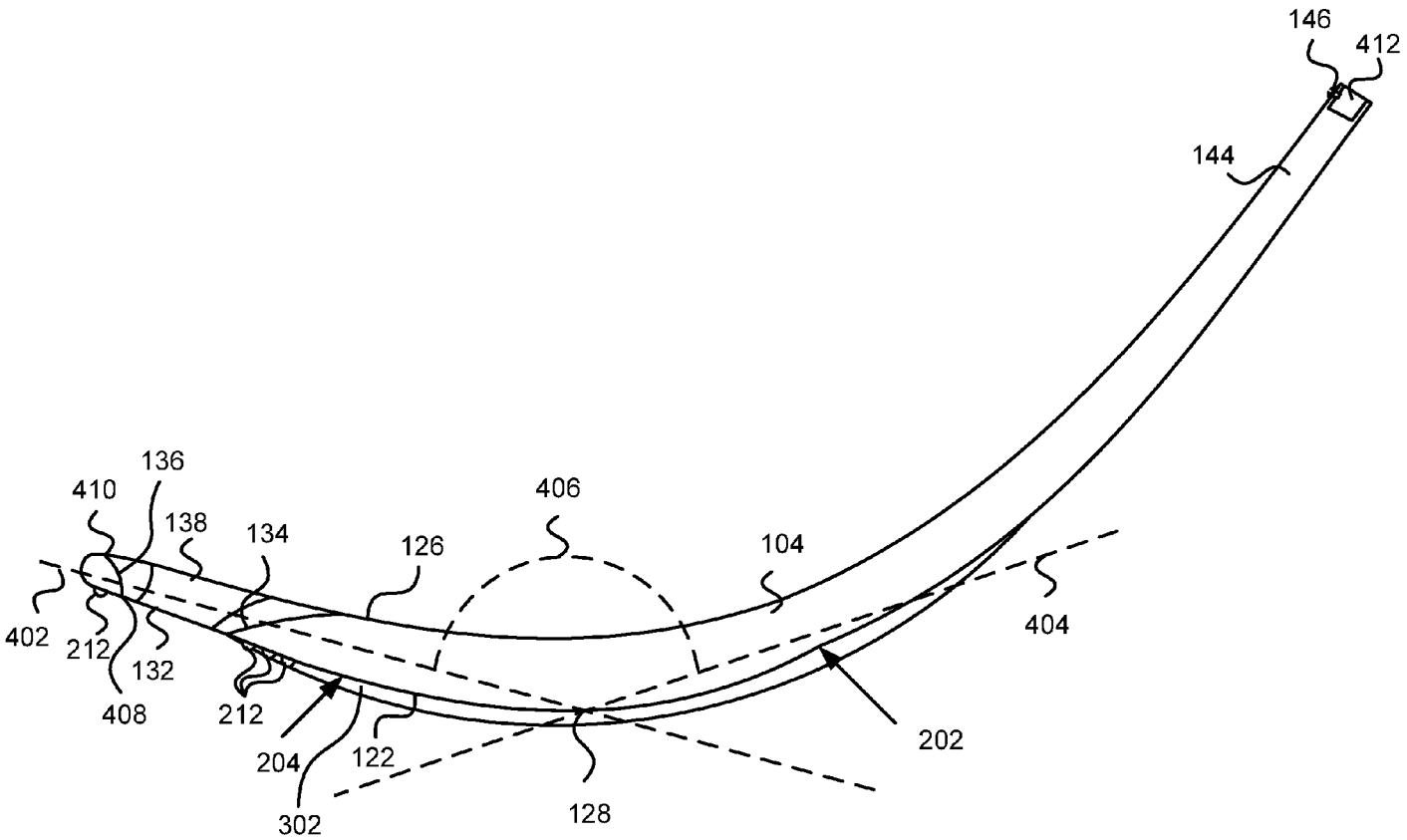
FIG. 4 depicts a cutaway view of one embodiment of a snow interface taken along an axis of the snow interface in the direction of arrows A of FIG. 1.

FIG. 4 depicts a cutaway view of one embodiment of a snow interface 104 taken along the second axis 130 in the direction of arrows A of FIG. 1. As discussed above, in certain embodiments, a plane 404 that most closely approximates the curvature of the gliding section 202 and a plane 402 that most closely approximates the curvature of the engagement section 204 are aligned at an obtuse angle 406 with respect to one another. For example, if an imaginary plane were fitted along the curvature of the gliding section 202 using simple linear regression such that the sums of vertical the distances between the actual position on the curvature of the gliding section 202 and the imaginary fitted plane were minimized, the imaginary plane would approximate plane 404. Similarly, if an imaginary plane were fitted along the curvature of the engagement section 204 using simple linear regression such that the sums of vertical the distances between the actual position on the curvature of the engagement section 204 and the imaginary fitted plane were minimized, the imaginary plane would approximate plane 402. As will be evident to one of skill in the art, plane 404 is positioned at an obtuse angle 406 with respect to plane 404.

In certain embodiments, as discussed above, the engagement member 132 includes an aperture 138 disposed through the snow interface 104 and one or more cleats 212 disposed on engagement section 204 of the gliding surface 122. In other embodiment, the engagement member 132 may include only an aperture 138. In another embodiment, the engagement member 132 may include only cleats 212.

When the snow interface 104 is positioned in the slowing position, with plane 402 positioned substantially parallel to the snow 101, the aperture 138 and/or cleats 212 engage the snow 101 to limit further movement of the snow interface 104 with respect to the snow 101.

The aperture 138, in one embodiment, extends from the engagement section 204 of the gliding surface 122 and through the propulsion surface 126. In other embodiments, the aperture 138 may only extend through the gliding surface 122 and not through the propulsion surface 126. The aperture 132 includes a leading surface 134 and a trailing surface 136. When the engagement section 204 of the snow interface 104 is positioned in the slowing position, the trailing surface 136 engages the snow 101 covering the snow covered surface to increase a frictional resistance between the snow interface 104 and the snow 101 covering the snow covered surface. The increased frictional resistance between the snow interface 104 and the snow 101 covering the snow covered surface can be used to slow or stop the user.

In one embodiment, the trailing surface 136 of the aperture 138 extends from the gliding surface 122 to the propulsion surface 126. An interface between the gliding surface 122 and the trailing surface 136 forms an engagement edge 408. An interface between the propulsion surface 126 and the trailing surface 136 forms a propulsion edge 410. In one embodiment, the engagement edge 408 extends to a position substantially closer to the leading surface 134 leading surface than the propulsion edge 410 such that the trailing surface 136 of the aperture 138 is sloped in an upward manner. When the snow interface 104 is positioned in the slowing position, the engagement edge 408 engages the snow 101 covering the snow covered surface to slow or stop movement of the snow interface 104 with respect to the snow 101. The upward slope of the trailing surface 136, in one embodiment, causes the snow interface 104 to be driven further into the snow 101 covering the snow covered surface thereby increasing the frictional resistance between the snow interface 104 and the snow 101.

In one embodiment, a flange (not shown) coupled to the support member 102 is received within a receiving space 412 within the neck 144 of the snow interface 104. A set screw 146 extends through the neck 144 of the snow interface 104 to couple the snow interface 104 to the support member 102. In other embodiments, the set screw 146 may be replaced with a push pin (not shown) that is received within a hole (not shown) in the neck 144 of the snow interface 104. In such an embodiment, the snow interface 104 may be quickly and easily removed from the support member 102 and replaced with a second snow interface having differing handling characteristics. Other quick release mechanisms are known in the art and may replace the push pin quick release mechanism described herein.

Figure 5:
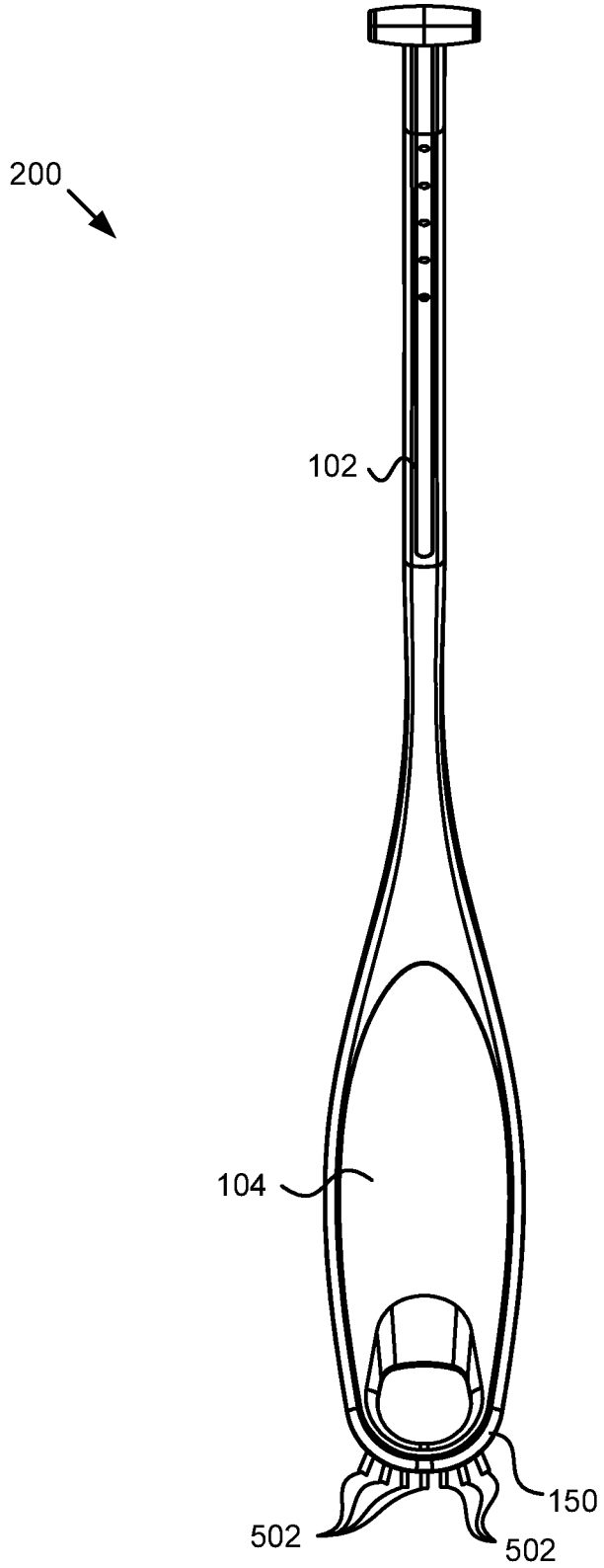
FIG. 5 depicts a top view of one embodiment of an apparatus for controlling movement of a user on snow, the apparatus including cleats extending perpendicularly from a propulsion rim of the snow interface.

FIG. 5 depicts a top view of one embodiment of an apparatus 200 for controlling movement of a user on snow 101. In certain embodiments, the apparatus 200 includes a support member 102 and a snow interface 104. The support member 102 and the snow interface 104 are substantially similar to support member 102 and the snow interface 104 of apparatus 100 discussed above.

In one embodiment, at least one propulsion cleat 502 extends perpendicularly from the propulsion rim 150 of the snow interface 104. In certain embodiments, the propulsion cleats 502 extend in a plane substantially parallel or equal to a plane 602 (FIG. 6) that most closely approximates the curvature of the engagement section 204 of the gliding surface 122. In other embodiments the propulsion cleats 502 may extend at an angle that is slightly off parallel to a plane 602 (FIG. 6) that most closely approximates the curvature of the engagement section 204 of the gliding surface 122. By extending beyond the propulsion rim 150, the propulsion cleats 502 provide an engaging member that can engage the snow 101 covering the snow covered surface.

In use, with the snow interface 104 positioned in the propulsion position, the propulsion cleats 502 engage the snow 101 covering the snow covered surface to further limit movement of the snow interface 104 with respect to the snow 101. In embodiments where the apparatus 200 is used with hard packed or icy snow 101, the propulsion cleats 502 penetrate the hard packed or icy snow 101 so that a user can apply a propulsion force to the support member 102 to move about on the snow 101.

In certain embodiments, the propulsion cleats 502 may act as both a propulsion member as well as an engagement member. In use, when the user wishes to use the propulsion cleats 502 to propel the user, the user rotates the support member 102 to orient the propulsion cleats in a position to engage the snow 101. The snow interface 104 may then be positioned in front of the user and the propulsion cleats 502 may be engaged with the snow 101. With the propulsion cleats 502 engaged with the snow 101, the user can pull on the support member 102 to propel themselves forward, backward, or side to side.

When the user wishes to use the propulsion cleats 502 as an engagement member to slow or stop their descent, the user rotates the support member 102 to orient the propulsion cleats in a position to engage the snow 101. The user can then engage the snow 101 and drag the propulsion cleats 502 along the snow 101 to slow or stop their descent.

In certain embodiments, the propulsion cleats 502 are removable or interchangeable. For example, where the snow conditions are soft, the user may wish to remove the propulsion cleats 502. In icy conditions, the user may wish to apply a propulsion cleat 502 having a sharper point to penetrate the icy snow 101. One of skill in the art will recognize that in other embodiments, the sharpness of the cleat may be varied to accommodate other snow 101 conditions.

Figure 6:
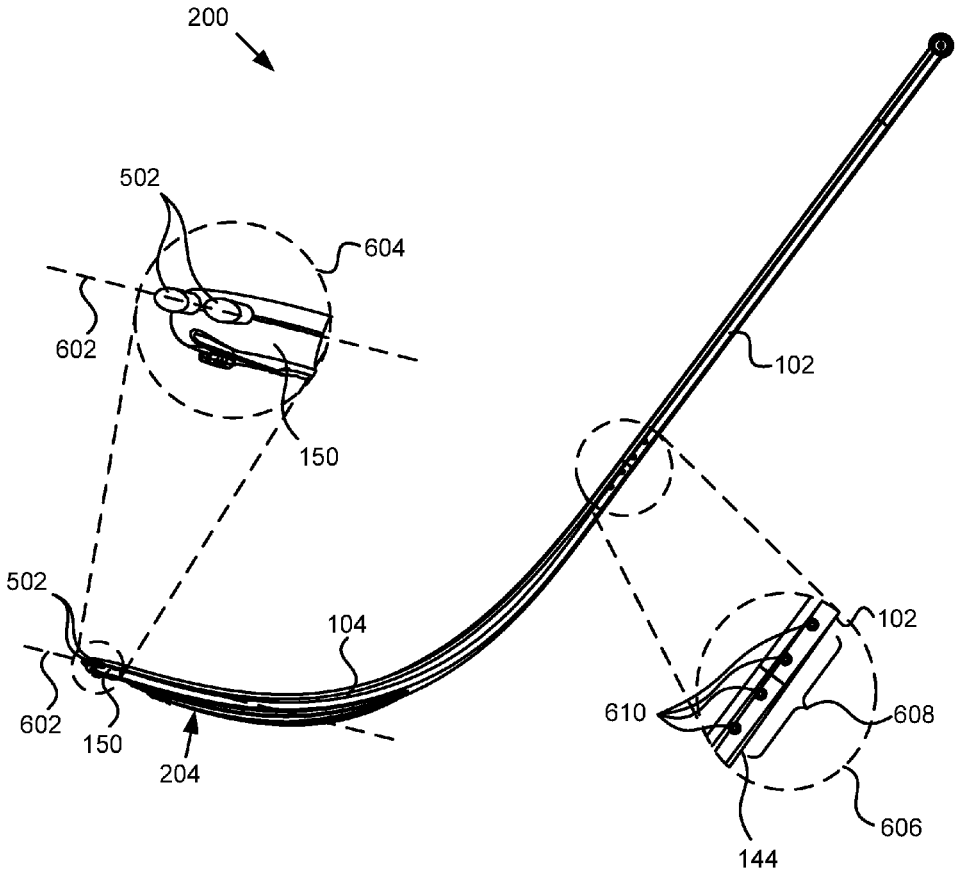
FIG. 6 depicts a side view of one embodiment of an apparatus for controlling movement of a user on snow including a blown up view of a front portion of a propulsion rim and cleats and a blown up view of a coupling between a support member and a neck of a snow interface.

FIG. 6 depicts a side view of an apparatus 200 for controlling movement of a user on snow 101 including a blown up view 604 of a front portion of the propulsion rim 150 and propulsion cleats 502. As discussed above, in certain embodiments, the propulsion cleats 502 extend perpendicularly from the propulsion rim 150 in a plane 602 that most closely approximates the curvature of the engagement section 204 of the gliding surface 122.

FIG. 6 also depicts a blown up view 606 of one embodiment of a coupling 608 between the support member 102 and the neck 144 of the snow interface 104. In certain embodiments, a coupling member (not shown) having an outer diameter slightly smaller than an inner diameter of the support member 102 and an inner diameter of the neck 144 of the snow interface 104 is positioned within the receiving space 412 in the neck 144 of the snow interface 104 and a receiving space (not shown) in the support member 102.

Set screws 610 are positioned through the neck 144 of the snow interface 104 and through the support member 102 to engage the coupling member (not show) and fasten the snow interface 104 to the support member 102. In other embodiments, push pins or other quick release fasteners may be used in place of the set screws 610 to quickly and easily fasten the snow interface to the support member 102. In one embodiment, the coupling member (not shown) may be integral with one of the snow interface 104 and the support member 102 and may be sized and shaped to be received within a receiving space (not shown) in the other of the snow interface 104 and the support member 102. In such an embodiment, fewer set screws 610 may be used to secure the snow interface 104 to the support member 102 because the coupling member is integral with one of the snow interface 104 or the support member 102.

Figure 7:
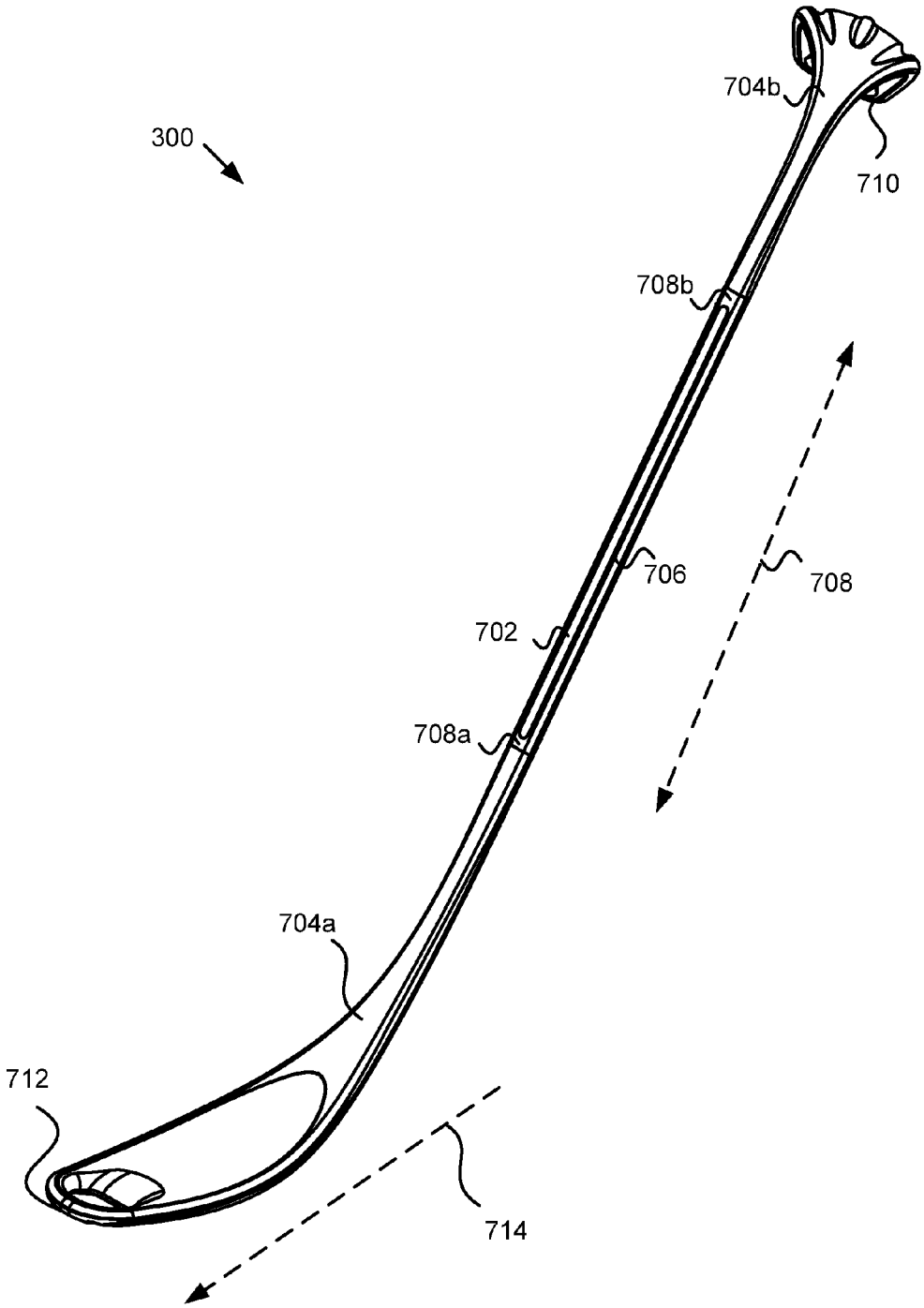
FIG. 7 depicts a perspective view of one embodiment of an apparatus for controlling movement of a user on snow, the apparatus including two snow interfaces.

FIG. 7 depicts a perspective view of one embodiment of an apparatus 300 for controlling a snow traversal device in traversing snow 101 covering a surface. In certain embodiments, the apparatus includes a support member 702 and two snow interfaces 704*a* and 704*b*.

The support member 702, in one embodiment, is a shaft 706 elongated in a lengthwise direction 708. The shaft 706 is made from a substantially rigid material for supporting a user. For example, in certain embodiments, the shaft 706 may be made of aluminum, fiberglass, carbon fiber, plastic, or any other material having a structural resiliency sufficient to support a user.

In certain embodiments, a snow interface 704*a* and 704*b* is coupled to each end 709*a* and 709*b* of the support member 706. The snow interfaces 704*a* and 704*b*, in one embodiment, are substantially similar to the snow interface 104 described above.

A double ended apparatus, such as the apparatus 300 illustrated in FIG. 7, may be particularly useful for skiers or monoboarders. As will be evident to one of skill in the art, a snowboarder typically stands perpendicular to a snowboard. When the snowboarder uses a single ended apparatus, such as apparatus 100 or 200 discussed above, the snowboarder will typically grasp the handle 120 of the apparatus 100 or 200 with their leading hand, that is, the hand of the user that will be further downhill when the user descends the slope. When the user grasps the support member 102 with their other hand, the snow interface 104 will be positioned closer to the user's uphill side. This arrangement leaves the user is a position to easily and comfortably drag the snow interface 104 along the snow 101 to control their rate of descent or to provide support to the user when the user carves a deep turn.

When a skier descends a slope, neither hand is particularly oriented further downhill than the other. Therefore, the user may wish to use the apparatus on either side. An apparatus 300 having snow interfaces 704*a* and 704*b* positioned on either side of the user allows the user to quickly and easily engage the snow 101 on either side of the user. Of course, one of skill in the art will recognize that a double ended apparatus 300 may also be used by a snowboarder even though the snowboarder does not stand parallel to the snowboard.

In one embodiment, the snow interfaces 704*a* and 704*b* are positioned in an offset position relative to one another. For example, in the embodiment illustrated in FIG. 7, snow interface 704*b* is positioned such that a front end 710 of the snow interface 704*b* extends through the plane of the illustration while snow interface 704*a* is positioned such that a front end 712 of snow interface 704*a* extends in the direction indicated by arrow 714. In other embodiments, the snow interfaces 704*a* and 704*b* may be positioned such that their respective front ends 710 and 712 extend at right angles to one another. One of skill in the art will recognize that in certain embodiments, the angle of offset between snow interfaces 704*a* and 704*b* may be any angle in a three hundred and sixty degree radius. In one embodiment, the offset between snow interfaces 704*a* and 704*b* may be adjustable by a user.

Figure 8:
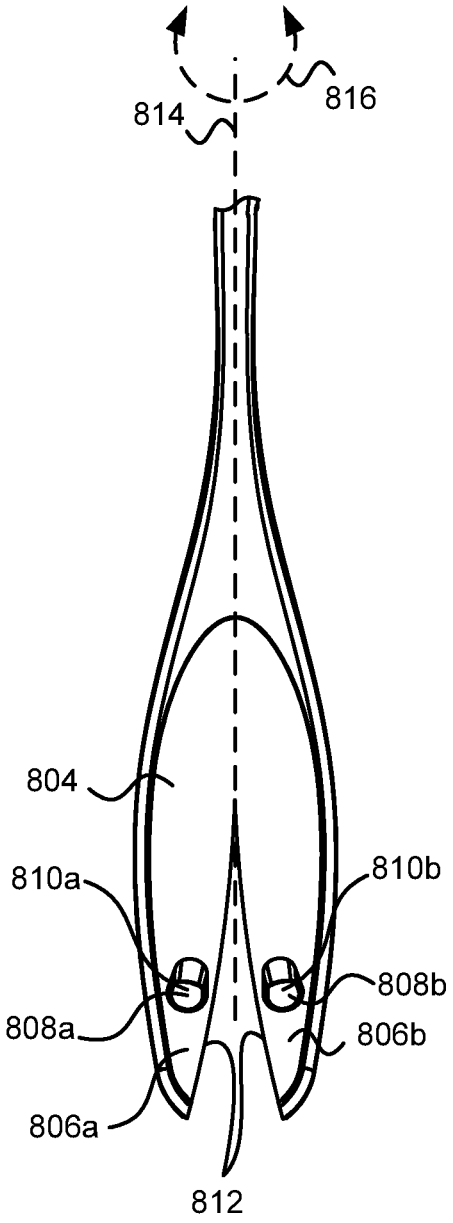
FIG. 8 depicts a top view of one embodiment of a snow interface including a plurality of fins.

FIG. 8 depicts a top view of one embodiment of a snow interface 804. In certain embodiments, the snow interface 804 may include a plurality of fins 806*a* and 806*b* extending away from the coupling between the snow interface 804 and the support member 102 (FIG. 1).

In one embodiment, each fin 806*a* and 806*b* includes an engagement member 808*a* and 808*b*. As illustrated in FIG. 8, each engagement member 808*a* and 808*b* may be an aperture 810*a* and 810*b* disposed through the engagement section 812 of the snow interface 804. Each aperture 810*a* and 810*b* is shaped substantially similar to the apertures 138 of apparatus 100, 200, and 300 described above. Accordingly, in certain embodiments, each aperture 810*a* and 810*b* operates in a substantially similar manner the apertures 138 of apparatus 100, 200, and 300 described above.

In one embodiment, to engage the apertures 810*a* and 810*b* of the engagement member 808*a* and 808*b*, the snow interface 804 may be rotated about a longitudinal axis 814 of the snow interface 804 in the direction indicated by arrows 816. In such an embodiment, only one of the apertures 810*a* and 810*b* of the engagement member 808*a* and 808*b* may be engaged with the snow 101 at any given time depending on the direction of rotation of the snow interface 804. In other embodiments, such as where the snow interface is not rounded about the longitudinal axis 814 of the snow interface 804, both of the apertures 810*a* and 810*b* of the engagement member 808*a* and 808*b* may be engaged with the snow 101 at approximately the same time.

Figure 9:
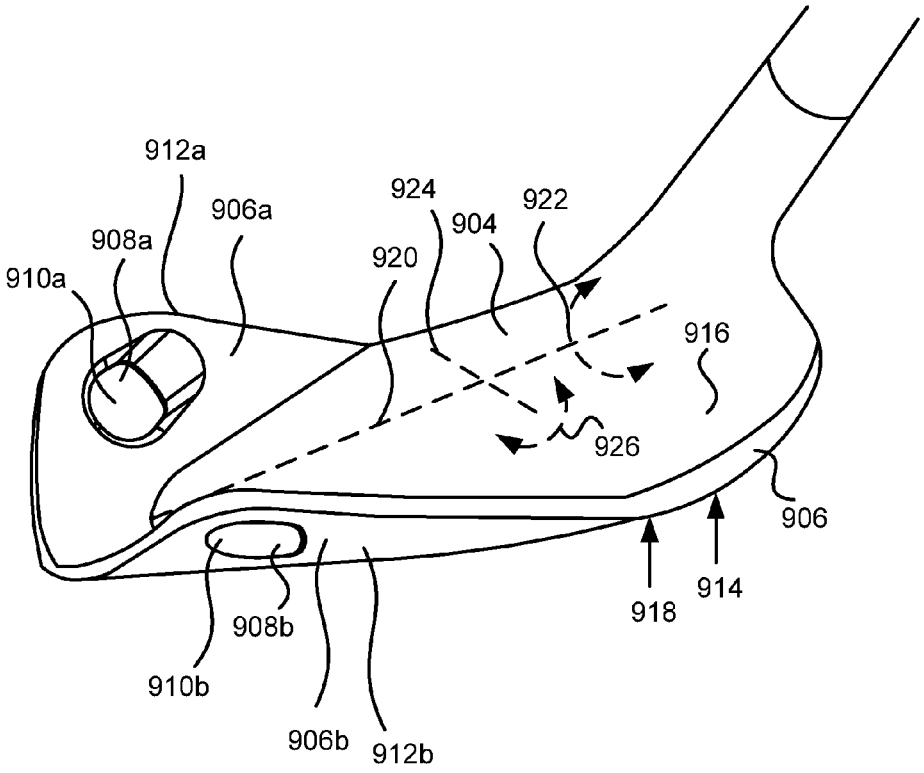
FIG. 9 depicts a perspective view of one embodiment of a snow interface having two engagement sections.

FIG. 9 depicts a perspective view of another embodiment of a snow interface 904. The snow interface 904 includes a gliding surface 914 positioned opposite a propulsion surface 916. The gliding surface 914 includes a gliding section 918 and two engagement sections 912*a* and 912*b*. The engagement sections 912*a* and 912*b* extend from the gliding section 918 and are positioned on upturned side portions 906*a* and 906*b* of the snow interface 904.

In certain embodiments, the upturned side portions 906*a* and 906*b* reduce the likelihood that the edge 908 of the snow interface 904 will catch the snow 101. Each upturned side portion 906*a* and 906*b* includes an engagement member 908*a* and 908*b* respectively. In one embodiment, each engagement member 908*a* and 908*b* may be an aperture 910*a* and 910*b* disposed through the engagement sections 912*a* and 912*b* of the snow interface 904. The apertures 910*a* and 910*b* are substantially similar to the apertures 138, 810*a* and 810*b* described above.

In use, when descending a slope, a user positions the snow interface in a substantially parallel relationship with the snow 101 such that the gliding section 918 is in contact with the snow 101 and the engagement sections 912*a* and 912*b* are out of contact with the snow 101. To slow or stop the user's momentum, the user rotates the snow interface 904 about a longitudinal axis 920 of the snow interface 904 in the direction of arrows 922. By rotating the snow interface 904 about the longitudinal axis 920 of the snow interface 904 either engagement section 912*a* or engagement section 912*b* will be positioned in contact with the snow 101 and the gliding section 918 will be positioned out of contact with the snow 101. The user may also pivot the snow interface 904 about a second axis 924 in the direction indicated by arrows 926 to position the engagement sections 912*a* and/or 912*b* in contact with the snow 101. The second axis 924 is substantially perpendicular to the first axis 920.

Figure 10:
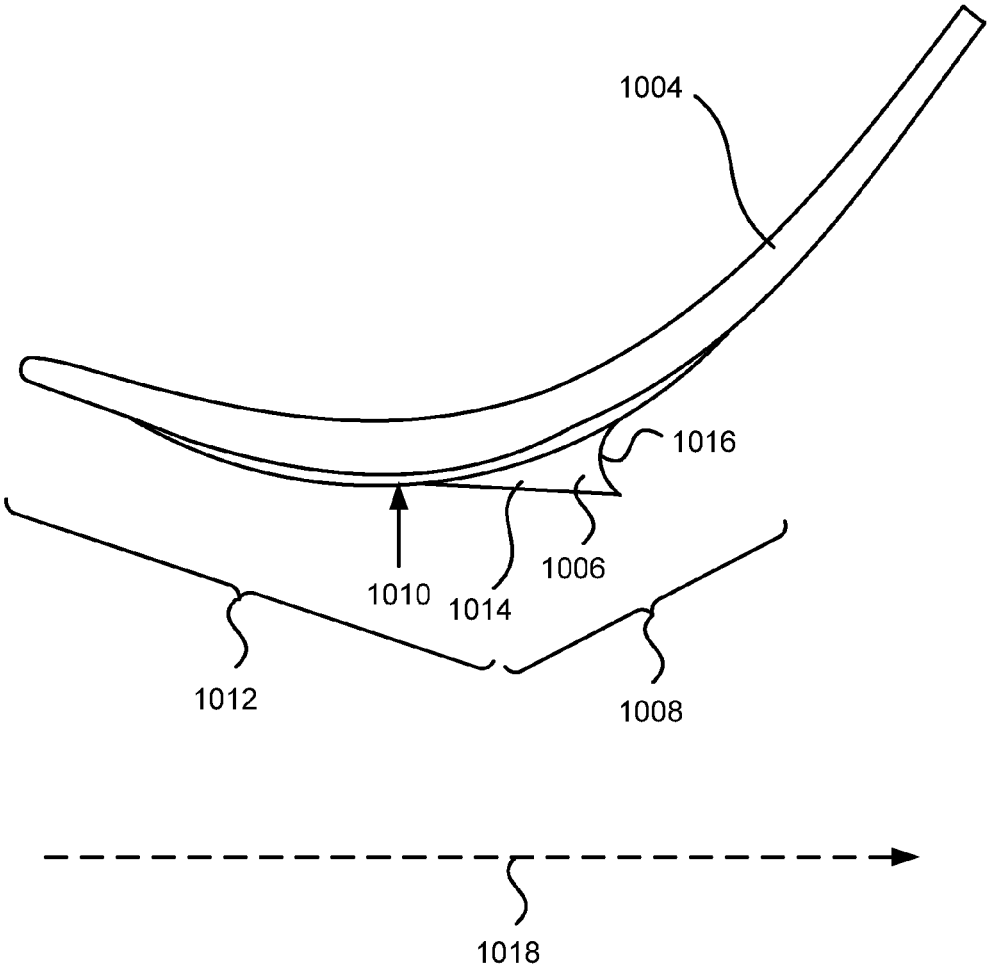
FIG. 10 depicts a side view of one embodiment of a snow interface having an engagement member positioned near a coupling between a snow interface and a support member.

FIG. 10 depicts a side view of another embodiment of a snow interface 1004. While the embodiments discussed above include engagement members positioned near an end of the snow interface opposite the end of the snow interface that is connected to the support member, one of skill in the art will recognize that the engagement member may be positioned near the end of the snow interface that is connected to the support member. FIG. 10 illustrates one example of such an embodiment.

In the embodiment illustrated in FIG. 10, the engagement section 1008 of the gliding surface 1010 is positioned closer to the support member (not shown) than the gliding section 1012 of the gliding surface 1010. An engagement member 1006 is positioned on an engagement section 1008 of the gliding surface 1010. In certain embodiments, the engagement member 1006 is a flange 1014 that extends substantially perpendicularly from the gliding section 1012 of the gliding surface 1010. In one embodiment, the flange 1014 may include a substantially concave section 1016 pointing in the typical direction of travel as indicated by arrow 1018. When the snow interface 1004 is positioned in the slowing position with the engagement section 1008 in contact with the snow 101, the concave section 1016 engages the snow 101 to slow or stop movement of the snow interface with respect to the snow 101.

Figure 11:
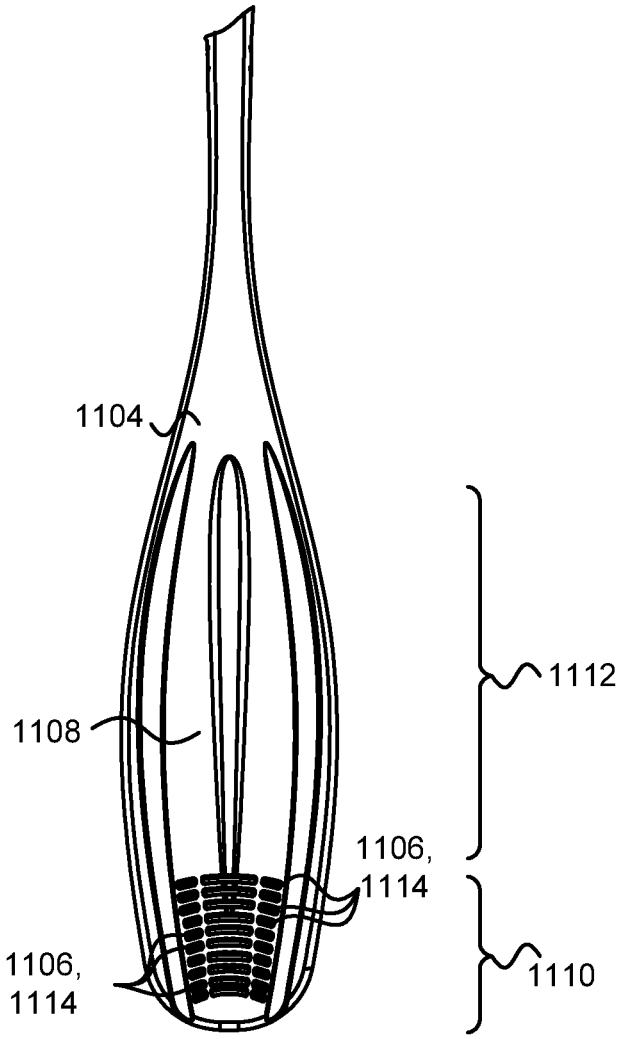
FIG. 11 depicts a bottom view of one embodiment of a snow interface having a plurality of cleats as engagement members.

FIG. 11 depicts a bottom view of another embodiment of a snow interface 1104. While most of the embodiments discussed above depict the snow interfaces as having at least one aperture as an engagement member, one of skill in the art will recognize that in certain embodiments, the engagement member 1114 may be one or more cleats 1106 extending substantially perpendicularly from the gliding surface 1108 on the engagement section 1110 of the gliding surface 1108. In such an embodiment, an aperture, such as the apertures described above, may be unnecessary.

The snow interface 1104 depicted in FIG. 11 operates in a manner substantially similar to the manner in which snow interfaces that include an aperture as an engagement member operate. That is, the gliding surface 1108 of the snow interface 1104 includes a gliding section 1112 and an engagement section 1110. The snow interface 1104 is positionable between a gliding position and a slowing position. In the gliding position the gliding section is in contact with the snow 101 and the engagement section 1110 (and thus the engagement members 1114) are positioned out of contact with the snow 101. In the slowing position the engagement section 1110 (and thus the engagement members 1114) are positioned in contact with the snow 101 and the gliding section 1112 is positioned out of contact with the snow 101.

Figure 12:
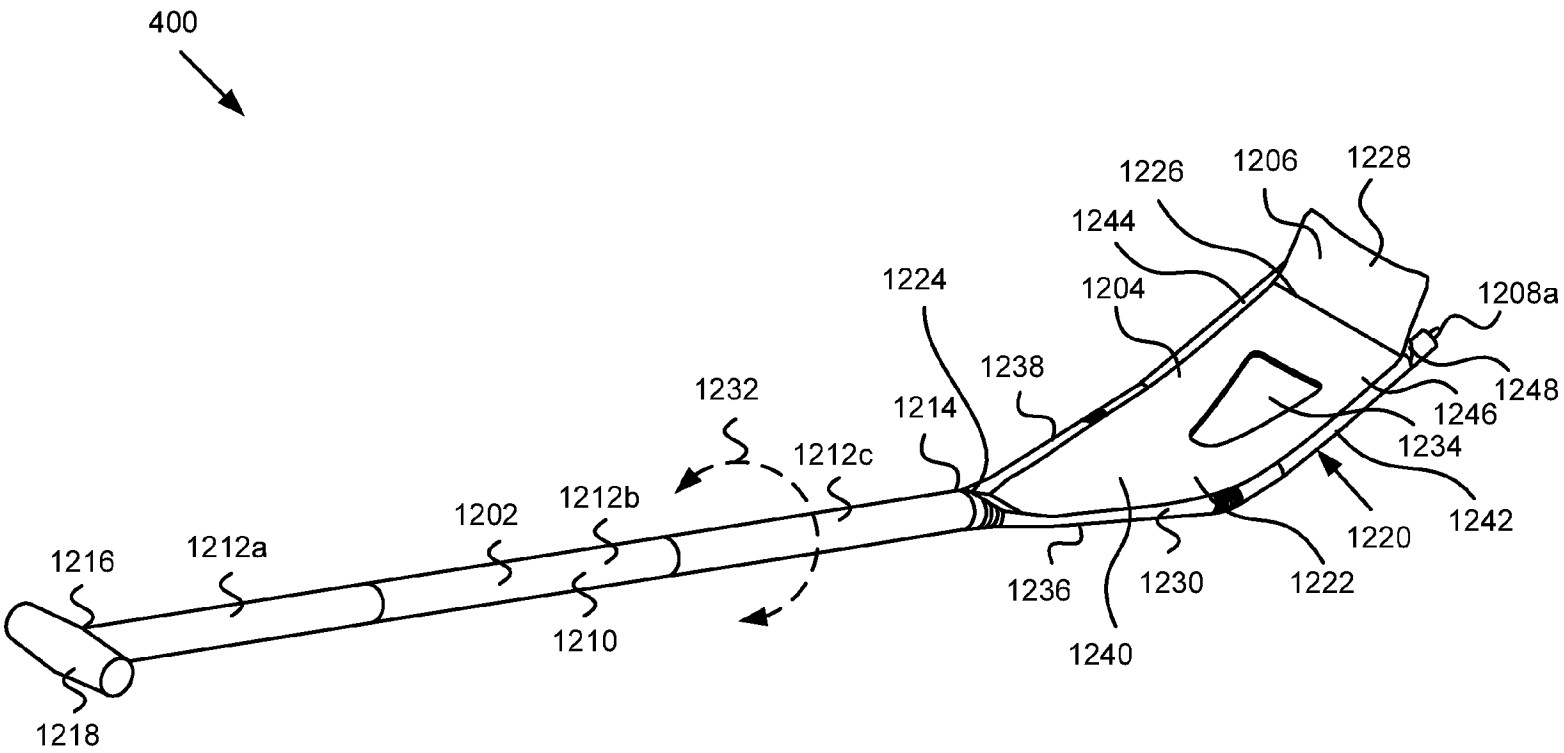
FIG. 12 depicts a perspective view of one embodiment of an apparatus for controlling movement of a user on snow.

FIG. 12 depicts a perspective view of one embodiment of an apparatus 400 for controlling a snow traversal device in traversing snow 101 covering a surface. The apparatus 400 includes a support member 1202, a snow interface 1204, an engagement member 1206 and at least one propulsion cleat 1208.

The support member 1202, in one embodiment, includes a shaft 1210 made from a substantially rigid material for supporting a user. The support member 1202 includes a first end 1214 and a second end 1216 with the snow interface 1204 coupled to and extending from the first end 1214 and a handle 1218 coupled to the second end 1216.

In certain embodiments, the support member 1202 includes separable sections 1212*a*, 1212*b*, and 1212*c*. The sections 1212 are removably coupled to one another such that the overall length of the support member 1202 may be adjusted. By adjusting the length of the support member 1202, the user can easily store the apparatus 1200 in a backpack or other storage area when the apparatus 1200 is not needed.

The snow interface 1204, in certain embodiments, includes a gliding surface 1220 positioned opposite a propulsion surface 1222. A coupled end 1224 of the snow interface 1204 is positioned opposite a free end 1226. The coupled end 1224 is coupled to the first end 1214 of the support member 1202 such that the snow interface 1204 extends from the first end 1214 of the support member 1202.

An engagement member 1206 is coupled to the free end 1226 of the snow interface 1204. In certain embodiments, the engagement member 1206 is an engagement flange 1228 that extends away from the propulsion surface 1222 of the snow interface 1204 in a direction substantially opposite a direction of the gliding surface 1220 of the snow interface 1204. In one embodiment, the engagement flange 1228 extends from the propulsion surface 1222 at an angle between about ninety and about one hundred and thirty five degrees with respect to the plane of the propulsion surface 1222. In certain embodiments, the propulsion surface 1222 is concave. In such an embodiment, the engagement flange 1228 extends from the propulsion surface 1222 at an angle between about ninety and about one hundred and thirty five degrees with respect to an average plane of the propulsion surface 1222. In other embodiments, the engagement flange 1228 extends perpendicularly from the propulsion surface 1222. Again, in embodiments where the propulsion surface 1222 is concave, the engagement flange 1228 extends perpendicularly from an average plane of the propulsion surface 1228.

In use, when the user wishes to slow or stop their descent down a snow covered slope, the user rotates the support member 1202 in the direction indicated by arrows 1232 to position the engagement flange 1228 in an engagement position. In the engagement position, the engagement flange 1228 is directed towards the snow covered slope and the user can apply pressure to the engagement flange 1228 to engage the snow and slow or stop the user's descent.

As discussed above, as the user drags the engagement flange 1228 along the snow 101, loose snow 101 may accumulate under the propulsion surface 1222 causing the propulsion surface 1222 and the engagement flange 1228 to rise up and over the accumulated snow 101. To discharge the accumulated snow 101, in certain embodiments, the snow interface 1204 may include an aperture 1234 that extends all the way through the snow interface 1204 from the propulsion surface 1222 to the gliding surface 1220. As the snow 101 accumulates under the propulsion surface 1222, the snow 101 is discharged through the aperture 1234, thus avoiding the problems associated with accumulated snow 101.

In one embodiment, the snow interface 1204 includes a frame structure 1230 that supports the propulsion surface 1222 and the gliding surface 1220. The frame structure 1230, in certain embodiments, includes a first frame member 1236 and a second frame member 1238. The first frame member 1236 and the second frame member 1238 extend from the support member 1202 to define a substantially triangular area 1240. The propulsion surface 1222 and the gliding surface 1220 extend between the first frame member 1236 and the second frame member 1238 to fill the substantially triangular area 1240.

The first frame member 1236 and a second frame member 1238 also include substantially parallel sections 1242 and 1244 respectively. The substantially parallel sections 1242 and 1244 are positioned in a parallel orientation relative to one another to define a substantially rectangular area 1246. The propulsion surface 1222 and the gliding surface 1220 extend between the first frame member 1236 and the second frame member 1238 to fill the substantially rectangular area 1246. In certain embodiments, the frame structure 1230 may also include a bracing member 1248 positioned on the free end 1226 of the snow interface 1204. The bracing member 1248 extends between the first frame member 1236 and a second frame member 1238 to support the propulsion surface 1222 and the gliding surface 1220.

Propulsion cleats 1208*a* and 1208*b* (see FIG. 13) are coupled to and extend from the free end 1226 of the snow interface 1204. In certain embodiments, the propulsion cleats 1208*a* and 1208*b* extend from the free end 1226 of the snow interface 1204 in a plane that is approximately the same as the plane of the snow interface 1204. In use, to propel a user, the propulsion cleats 1208*a* and 1208*b* are positioned such that they may be driven into the snow 101 covering the surface. In this position, the user engages the propulsion cleats 1208*a* and 1208*b* with the snow 101 covering the surface and pulls or pushes on the support member 1202 to move the user forward, backward, or side to side.

Figure 13:
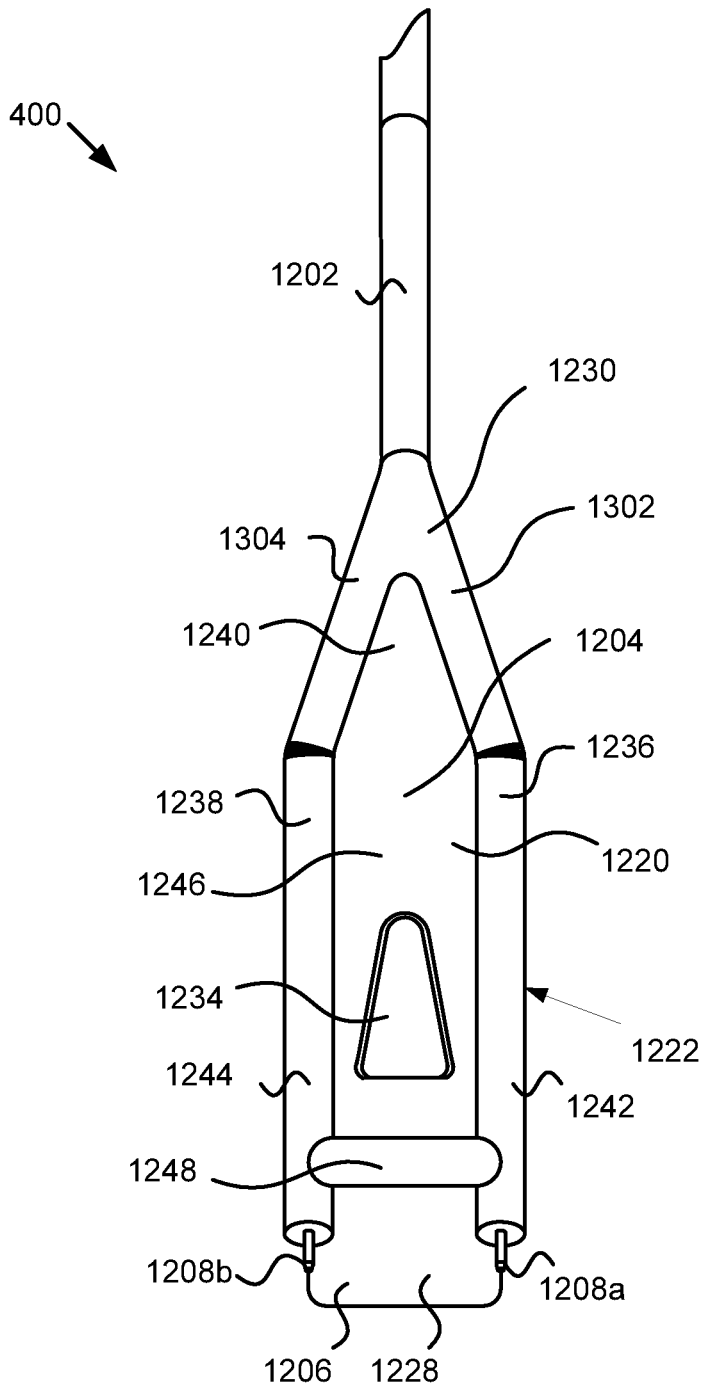
FIG. 13 depicts a bottom view of one embodiment of an apparatus for controlling movement of a user on snow

FIG. 13 depicts a bottom view of one embodiment of an apparatus 400 for controlling a snow traversal device in traversing snow 101 covering a surface. As can be seen in the embodiment illustrated in FIG. 13, in certain embodiments, the apparatus 400 includes two propulsion cleats 1208*a* and 1208*b* that may be used to engage the snow 101 to propel the user. FIG. 13 also more clearly shows the bracing member 1248 extending between the first frame member 1236 and a second frame member 1238 to support the propulsion surface 1222 and the gliding surface 1220.

In certain embodiments, the gliding surface 1220 may lie at a different plane than a plane of parallel sections 1242 and 1244 of the first and second frame member 1236 and 1238. In such an embodiment, the parallel sections 1242 and 1244 of the first and second frame member 1236 and 1238 may act as gliding members that are engageable with the surface of the snow 101 to facilitate tracking of the gliding surface 1220 of the snow interface 1204 along the surface of the snow 101.

In one embodiment, divergent sections 1302 and 1304 of the frame structure 1230 extend from the support member 1202 at a first angle and the parallel sections parallel sections 1242 and 1244 of the first and second frame member 1236 and 1238 extend from the divergent sections 1302 and 1304 of the frame structure 1230 at a second angle. In such an embodiment, the difference between the first and second angles cause the substantially triangular section 1240 to form a ramp when the substantially rectangular section 1246 is positioned parallel with the surface of the snow 101. When the user is descending a slope the ramp allows snow to pass under the gliding surface 1220 without catching on the substantially rectangular area 1246.

Figure 14:
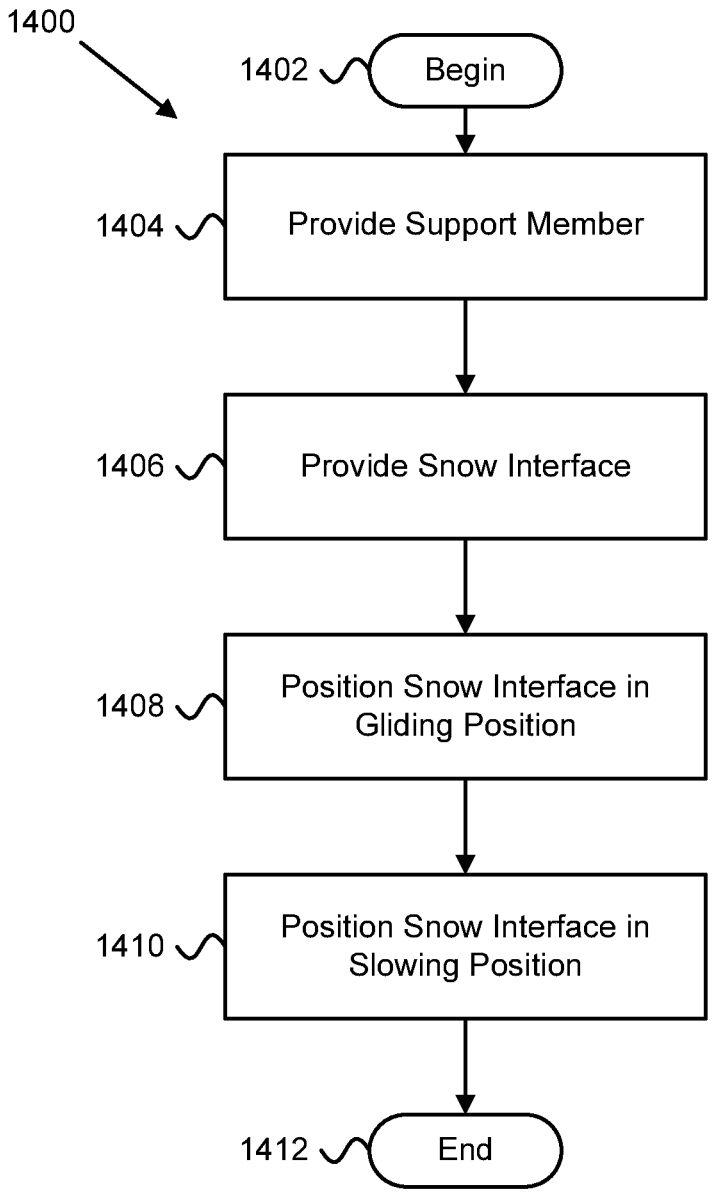
FIG. 14 depicts one embodiment of a method for controlling movement of a user on snow.

FIG. 14 depicts one embodiment of a method 1200 for controlling movement of a user on snow covering a surface. The method 1200 is described with reference to apparatus 100. However, one of skill in the art will recognize that the method 1200 may be performed using any apparatus described above.

The method begins 1402 and a support member 102 is provided 1404. As discussed above, in certain embodiments, the support member 102 includes a shaft 106 elongated in the lengthwise direction 108. The shaft 106 is made from a substantially rigid material for supporting a user.

A snow interface 104 is also provided 1406. The snow interface 104 extends from and is coupled to a first end 124 of the support member 102. The snow interface 104 includes a gliding surface 122 positioned opposite a propulsion surface 126. In certain embodiments, the gliding surface 122 includes a gliding section 202 and an engagement section 204 with the gliding section 202 and the engagement section 204 forming an obtuse angle with respect to one another. The gliding surface 122 is positionable between a gliding position and a slowing position. In the gliding position, the gliding section 202 of the gliding surface 122 is positioned in contact with the surface of the snow 101 and the engagement section 204 is positioned out of contact with the surface of the snow 101.

In certain embodiments, the engagement section 204 of the gliding surface 122 includes an engagement member 132. The engagement member 132 is engageable with the surface of the snow 101 when the snow interface 104 is positioned in the slowing position. In the slowing position the gliding section 202 of the gliding surface 122 is positioned out of contact with the surface of the snow 101.

In other embodiments, such as where apparatus 400 is used to perform the method 1400, the snow interface 1204 also includes a gliding surface 1220 positioned opposite the propulsion surface 1222. The snow interface 1204 includes a coupled end 1224 disposed opposite a free end 1226. The coupled end 1224 of the snow interface 1204 is coupled to the first end 1214 of the shaft 1210 of the support member 1202 and an engagement member 1206 is coupled to and extends from the free end 1226 of the snow interface 1204. The engagement member 1206 extends away from the propulsion surface 1222 of the snow interface 1204 in a direction substantially opposite the direction of the gliding surface 1220.

The method 1400 further includes positioning 1408 the snow interface 104 in the gliding position when a user is descending a snow 101 covered surface. In such a position, the gliding surface 122 (or 1220 of apparatus 400) glides along the surface of the snow 101. The user can use the support member 102 to support the user and to carve the snow traversal device to a deeper position while still maintaining his or her balance. To slow or stop the user, the user positions 1410 the snow interface 104 in the slowing position and the method 1400 ends 1412.

Figure 15:
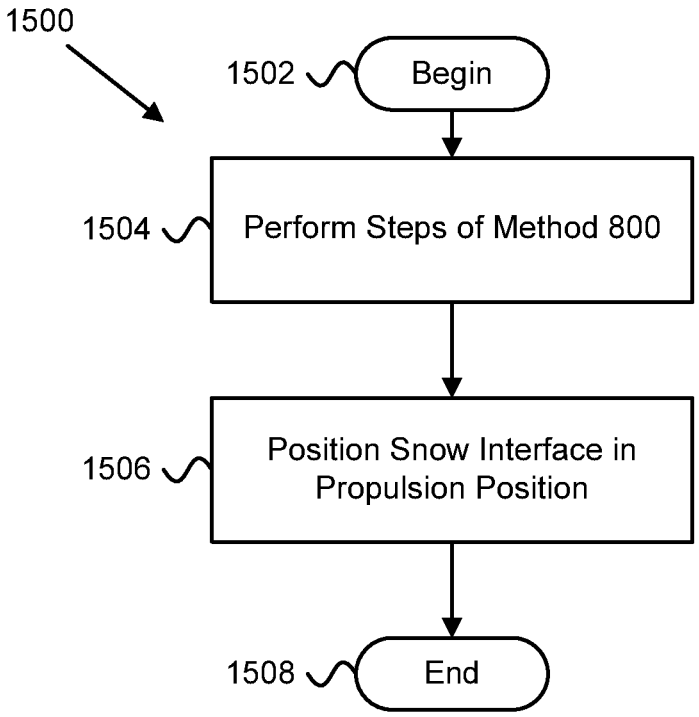
FIG. 15 depicts another embodiment of a method for controlling movement of a user on snow.

FIG. 15 depicts another embodiment of a method 1500 for controlling movement of a user on snow 101. In certain embodiments, the method 1500 begins 1502 and the steps of method 1400 are performed 1404. When the user is located at a substantially flat or inclined section on the snow covered surface, the user may position 1506 the snow interface 104 in a propulsion position. In one embodiment, in the propulsion position the snow interface 104 is engageable with the snow 101 to limit movement of the snow interface 104 with respect to the snow 101. In other embodiments, in the propulsion position at least one propulsion cleat, such as propulsion cleats 1208*a* and 1208*b* of apparatus 400, are engaged with the snow 101 to limit movement of the snow interface 1204 with respect to the snow 101. Once engaged with the snow 101, the user can pull or push on the support member 102 02 1202 to move the user in a forward, rearward, or sideward direction and the method 1500 ends 1508.

The apparatus, systems, and methods described herein provide a substantial improvement over anything in the prior art. As discussed above, with monoboarding and snowboarding a user's feet are fixed to a single monoboard or snowboard and there is no suitable system for engaging a user's upper body. With the devices and methods described herein, a monoboarder or snowboarder can engage their upper body for bleeding off speed in steep narrow runs, maintain momentum over flat spots, balance themselves on steep and icy traverses and stop themselves from falling over in the case of a slow-speed fall. The devices and methods described above can also be used to assist user's in exiting a ski lift which may be particularly useful for new users and those who are just learning to ride.

The apparatus, systems, and methods described above are also useful in skiing applications. Typically a skier uses a pair of ski poles as a pivot point about which the skier turns. However, ski poles are not designed to glide along the surface of the snow as a skier descends a snow covered slope. Further, ski poles do not assist a user in bleeding of speed or stopping. A skier may use the apparatus, systems, and methods described above to make deeper carving turns, maintain their balance in such a turn, and bleed off speed or stop themselves.

The present subject matter may be embodied in other specific forms without departing from its spirit or essential characteristics. The described embodiments are to be considered in all respects only as illustrative and not restrictive. The scope of the subject matter is, therefore, indicated by the appended claims rather than by the foregoing description. All changes which come within the meaning and range of equivalency of the claims are to be embraced within their scope.

What is claimed is:

1. An apparatus for controlling movement of a user on snow, the apparatus comprising:

a support member comprising a shaft, the shaft made from a substantially rigid material;

a snow interface coupled to and extending from a first end of the shaft, the snow interface comprising a gliding surface opposing a propulsion surface, the gliding surface comprising a continuous uninterrupted surface extending along a gliding section of the gliding surface and a raised or grooved gliding member extending lengthwise along the gliding section of the gliding surface;

an engagement member coupled to one of the gliding surface and the propulsion surface; and wherein the snow interface is positionable between a gliding position and a slowing position, wherein in the gliding position, the gliding surface of the snow interface is positioned in contact with a surface of the snow, the gliding member engages the surface of the snow to facilitate tracking of the gliding surface along the surface of the snow and the engagement member is positioned out of contact with the surface of the snow, and wherein in the slowing position, the engagement member is positioned in contact with the surface of the snow.

2. The apparatus of claim 1, wherein the gliding surface comprises the gliding section and an engagement section and wherein the engagement member comprises an aperture disposed through the engagement section of the snow interface.

3. The apparatus of claim 2, wherein the aperture comprises a leading edge and a trailing edge, wherein in the slowing position, the trailing edge is engageable with the surface of snow.

4. The apparatus of claim 3, wherein the trailing edge of the aperture is sloped such that an interface between the trailing edge of the aperture and the engagement section of the snow interface form a substantially sharp engagement edge.

5. The apparatus of claim 1, further comprising a propulsion rim extending along an interface between the gliding surface and the propulsion surface, the propulsion rim engageable with the surface of the snow to limit movement of the snow interface with respect to the surface of the snow.

6. The apparatus of claim 5, further comprising at least one propulsion cleat extending perpendicularly from the propulsion rim.

7. The apparatus of claim 1, wherein the gliding surface is rounded about a first axis such that the gliding surface is substantially convex in a first dimension, the first axis substantially perpendicular to a longitudinal axis of the support member.

8. The apparatus of claim 7, wherein the gliding surface is rounded about a second axis such that the gliding surface is substantially convex in a second dimension, the second axis substantially perpendicular to the first axis.

9. The apparatus of claim 1, further comprising a replacement snow interface, wherein the snow interface is detachable and wherein the replacement snow interface is easily interchangeable with the snow interface.

10. The apparatus of claim 1, wherein a length of the support member is adjustable.

11. The apparatus of claim 1, further comprising a second snow interface extending from and coupled to a second end of the support member, the second end of the support member disposed opposite the first end of the support member.

* * * * *